US009150353B2

(12) United States Patent
Jackson

(10) Patent No.: US 9,150,353 B2
(45) Date of Patent: Oct. 6, 2015

(54) WIND-RESISTANT CONTAINER SYSTEMS, ANCHORING SYSTEMS, AND METHODS OF USE

(71) Applicant: Randy W. Jackson, Frisco, TX (US)

(72) Inventor: Randy W. Jackson, Frisco, TX (US)

(73) Assignee: Live Oak Intellectual Property, LLC, Frisco, TX (US)

( * ) Notice: Subject to any disclaimer, the term of this patent is extended or adjusted under 35 U.S.C. 154(b) by 70 days.

(21) Appl. No.: 13/951,234

(22) Filed: Jul. 25, 2013

(65) Prior Publication Data

US 2014/0034645 A1 Feb. 6, 2014

Related U.S. Application Data

(60) Provisional application No. 61/678,236, filed on Aug. 1, 2012.

(51) Int. Cl.

| | |
|---|---|
| ***B63B 17/00*** | (2006.01) |
| ***B65F 1/14*** | (2006.01) |
| *B65F 1/00* | (2006.01) |
| *B65F 1/06* | (2006.01) |
| *B65F 1/08* | (2006.01) |
| *B65F 1/16* | (2006.01) |

(52) U.S. Cl.

CPC ..... *B65F 1/141* (2013.01); *B65F 1/0006* (2013.01); *B65F 1/06* (2013.01); *B65F 1/08* (2013.01); *B65F 1/1468* (2013.01); *B65F 1/1615* (2013.01); *B65F 2001/1676* (2013.01); *B65F 2210/116* (2013.01); *B65F 2210/18* (2013.01); *B65F 2230/00* (2013.09); *B65F 2250/00* (2013.09); *Y10T 29/49826* (2015.01)

(58) Field of Classification Search

CPC ..... B65F 1/141; B63B 17/00; B60R 9/00
USPC ..... 220/783, 794, 908; 224/402, 403, 406; 248/220.21, 220.22

See application file for complete search history.

(56) References Cited

U.S. PATENT DOCUMENTS

| | | | | |
|---|---|---|---|---|
| 2,544,599 | A * | 3/1951 | Keelen | 114/364 |
| 4,014,456 | A * | 3/1977 | Echtle | 220/783 |
| 4,819,824 | A * | 4/1989 | Longbottom et al. | 220/266 |
| 4,878,596 | A | 11/1989 | Cawley et al. | |
| 5,437,386 | A * | 8/1995 | Von Holdt | 220/783 |
| 5,582,317 | A * | 12/1996 | Wermund | 220/789 |
| 5,799,961 | A * | 9/1998 | Schmeets | 280/163 |
| 5,875,902 | A * | 3/1999 | Emery et al. | 211/90.03 |
| 6,035,800 | A * | 3/2000 | Clifford | 114/347 |
| 6,367,403 | B1 * | 4/2002 | Carter | 114/343 |

(Continued)

*Primary Examiner* — Steven A. Reynolds
*Assistant Examiner* — King M Chu
(74) *Attorney, Agent, or Firm* — Workman Nydegger

(57) ABSTRACT

In an embodiment, a wind-resistant container system includes a container including a receiving space and an opening that provides access to the receiving space. The system also includes a lid connected to the container that is movable between an open position, and a closed portion, wherein the lid substantially covers the opening. One or more closure elements are configured to selectively secure the lid in the closed portion such that the receiving space is protected from wind. The system further includes an anchoring system operably connected to the container and configured to anchor the container on a wall structure without forming a permanent hole in the wall structure. The anchoring system includes a front portion positionable on a first surface of the wall structure and a back portion positionable on a second surface of the wall structure.

16 Claims, 24 Drawing Sheets

(56) References Cited

U.S. PATENT DOCUMENTS

| | | | | |
|---|---|---|---|---|
| 6,412,675 | B1 * | 7/2002 | Pope | 224/560 |
| 6,478,176 | B1 | 11/2002 | Reiter et al. | |
| 6,641,193 | B2 | 11/2003 | Alkevicius | |
| 6,971,697 | B2 | 12/2005 | Morales | |
| 7,482,928 | B2 | 1/2009 | Brackmann et al. | |
| 7,524,159 | B2 | 4/2009 | Mammone et al. | |
| 7,802,709 | B1 * | 9/2010 | Lewis et al. | 224/560 |
| 8,371,548 | B1 * | 2/2013 | Bishop | 248/311.2 |
| 2002/0109376 | A1 | 8/2002 | Gruich | |
| 2006/0011683 | A1 * | 1/2006 | Held | 224/406 |
| 2006/0118504 | A1 | 6/2006 | Willemsen | |
| 2009/0289060 | A1 | 11/2009 | Renard | |
| 2010/0294730 | A1 | 11/2010 | Weston | |

* cited by examiner

WIND-RESISTANT CONTAINER SYSTEMS, ANCHORING SYSTEMS, AND METHODS OF USE

CROSS-REFERENCE TO RELATED APPLICATIONS

This application claims priority to and the benefit of U.S. Provisional Application No. 61/678,236, filed Aug. 1, 2012, and entitled "Wind-Resistant Storage Systems," the disclosure of which is incorporated herein in its entirety by this reference.

BACKGROUND

A major concern in vehicles and watercrafts including usable spaces that can be susceptible to wind, sunlight, precipitation, and/or other elements of nature is containing and holding garbage, waste, refuge, and/or trash until permanent disposal. For example, truck owners often use their truck beds as mobile garbage cans. However, trash thrown in the back of trucks does not always stay put. Rather, at highway speed, with vehicles passing by, windy conditions, and bumpy roads, empty containers and other bits of trash within a truck bed can easily become airborne and turn into litter or roadway debris that destroys scenery and can be dangerous to people and wildlife. Moreover, picking up litter is costly for municipalities and transportation departments. Similarly, when exposed to wind and/or water, garbage, waste, refuse, and/or trash on boat decks can easily become airborne and pollute rivers and lakes. Further, other items (e.g., groceries, tools, fishing tackle, hunting gear, and/or sports equipment) that are commonly transported in truck beds or on boat decks can also become airborne and turn into litter if inadequately protected and/or improperly stored.

Some truck and watercraft owners have attempted to use conventional trash cans or five-gallon buckets to store trash, groceries, fishing tackle, tools, keys, gloves, and/or the like. However, conventional trash cans and five-gallon buckets are commonly unable to protect trash and/or other items from the strong and turbulent winds often present in truck beds and boat decks and are difficult to safely and conveniently secure. For example, the installation of trash cans in truck beds can be cumbersome, requiring drilling and painstaking measuring. Currently, to put a trash can in a truck bed one generally has to screw the trash can to the truck bed wall, leaving permanent holes and frequently with great frustration.

Thus, there remains a need for container systems that facilitate wind protection, convenient securement, use, and removal of trash or other items.

SUMMARY

One or more embodiments of the present invention solve one or more of the foregoing or other problems in the art with wind-resistant container systems that help conveniently and painlessly store trash, fishing tackle, tools, keys, gloves, and/or other items in areas such as truck beds and boat decks frequently exposed to high winds. In particular, one or more embodiments include container systems having one or more features that protect trash or other materials stored in a container from wind, sunlight, precipitation, and/or other forces. Such container systems can also include anchoring systems that are adaptable and can be used to anchor the container systems to walls or other structures of varying sizes. In addition, such anchoring systems can anchor the container systems to walls or other structures without the need of making permanent modifications to the wall or other structure.

For example, in an embodiment, a wind-resistant container system includes a container including a bottom, one or more side walls, a receiving space at least partially defined by the bottom and the one or more side walls, and an opening that provides access to the receiving space. The system also includes a lid connected to the container. The lid is movable between an open position, wherein the lid is moved away from the opening to provide access to the receiving space, and a closed position, wherein the lid substantially covers the opening. One or more closure elements are configured to selectively secure the lid in the closed position such that the receiving space is protected from wind. The system further includes an anchoring system operably connected to the container and configured to anchor the container on a wall structure without forming a permanent hole in the wall structure. The anchoring system includes a front portion positionable on a first surface of the wall structure and a back portion positionable on a second surface of the wall structure.

In another embodiment, an anchoring system for a pickup truck bed includes a fixed portion and a movable portion. The fixed portion includes a substantially horizontal section configured to engage an upper surface of a wall of the pickup truck bed and a substantially vertical section including a first clamping surface configured to engage a first side surface of the wall. The movable portion includes a pair of support arms. Each support arm includes a substantially horizontal section configured to engage the upper surface of the wall and a substantially vertical section. The movable portion also includes a plate member extending between the substantially vertical sections of the support arms. The plate member includes a second clamping surface configured to engage a second side surface of the wall. The second clamping surface is substantially parallel to the first clamping surface. The anchoring system also includes one or more threaded members extending between the fixed portion and the movable portion. Rotation of the one or more threaded members in a first direction moves the movable portion toward the fixed portion, and rotation of the one or more threaded members in a second direction moves the movable portion away from the fixed portion.

In another embodiment, a method of securing a wind-resistant container system on a wall includes providing a wind-resistant container system including a container. The container includes a lid movable between an open position and a closed portion. The wind-resistant container system also includes a support system including one or more support arms configured to hold or cradle the container and an anchoring system connected to the support system. The method also includes positioning the container in the support system and positioning a front portion of the anchoring system on a front surface of a wall. The method includes positioning a back portion of the anchoring system on a back surface of the wall and positioning a section of at least one of the front or back portions on an upper surface of the wall. The method includes moving the back portion of the anchoring system toward the front portion of the anchoring system to clamp the wall between the front and back portions. The method also includes securing the lid in the closed portion with the support system, wherein the support system includes one or more angled portions selectively positionable on the lid.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope, nor are the drawings necessarily drawn to scale. The invention will be described and explained with additional specificity and detail through the use of the accompanying drawings in which.

DETAILED DESCRIPTION

Figure 1A:
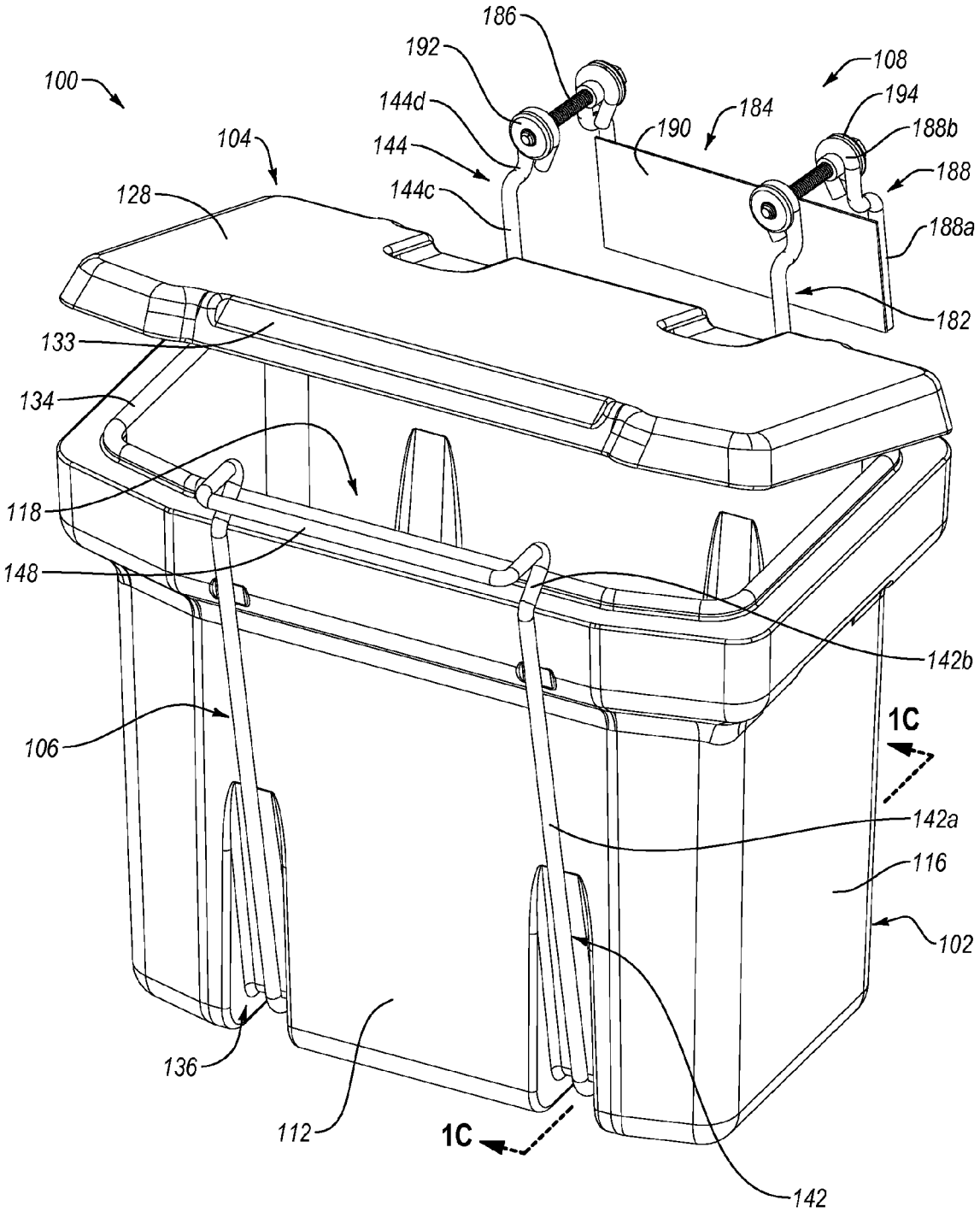
FIG. 1A is a front isometric view of a wind-resistant container system according to an embodiment (lid in open position)

The present invention is directed toward container systems and anchoring systems that help conveniently and painlessly store trash, fishing tackle, tools, keys, gloves, and/or other items in areas such as truck beds and boat decks frequently exposed to high winds. In particular, one or more embodiments include container systems having one or more features that protect trash or other materials stored in a container from wind, sunlight, precipitation, and/or other elements of nature. Such container systems can also include anchoring systems that are adaptable and can be used to anchor the container systems to walls or other structures of varying sizes. In addition, such anchoring systems can anchor the container systems to walls or other structures without the need of making permanent modifications to the wall or other structure.

FIGS. 1A through 1D illustrate a wind-resistant container system 100 according to an embodiment. The wind-resistant container system 100 can include a container 102, a lid 104, a support system 106, and an anchoring system 108.

Figure 1B:
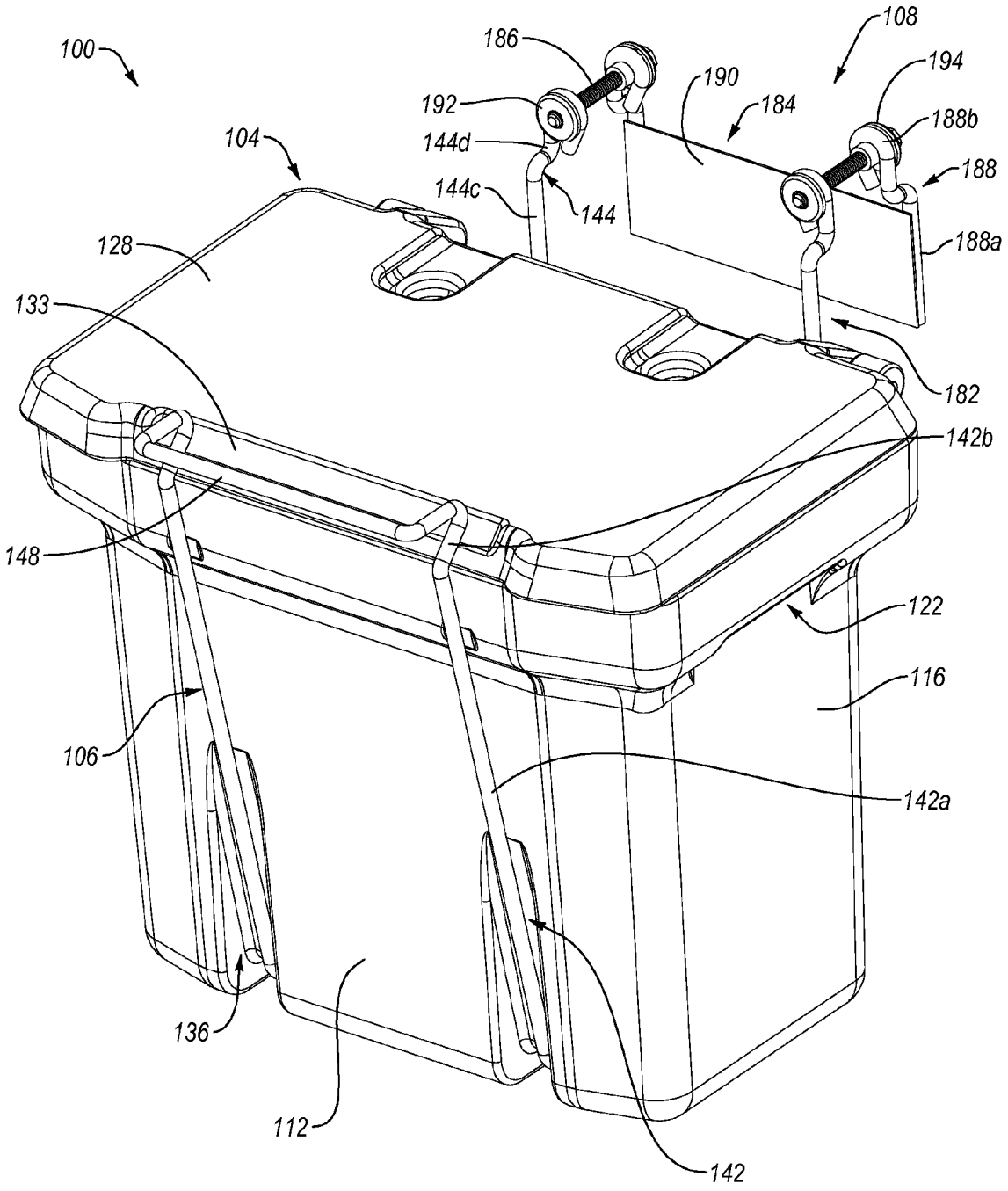
FIG. 1B is a front isometric view of the wind-resistant container system shown in FIG. 1A with the lid in a closed position.
Figure 1C:
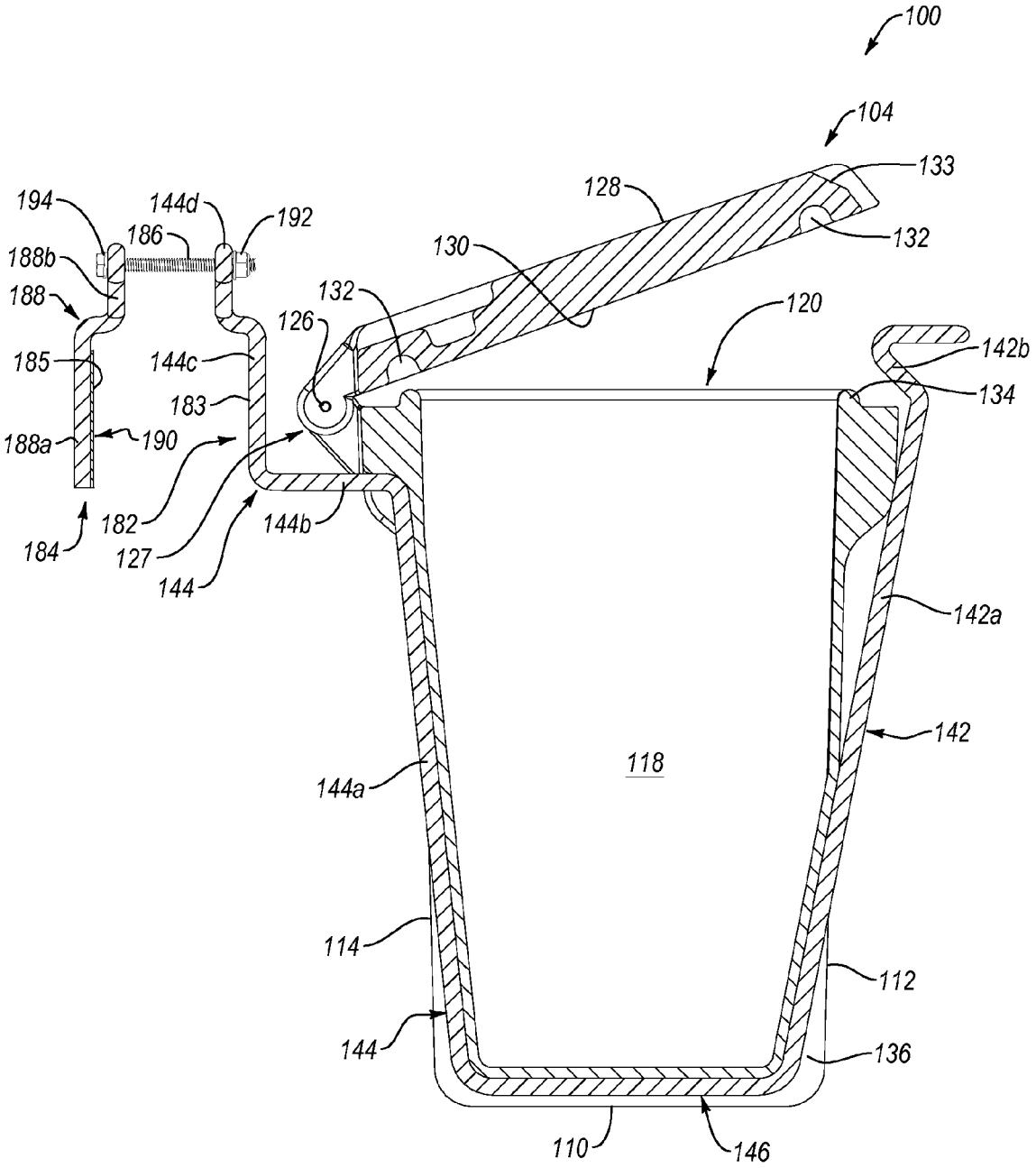
FIG. 1C is a cross-sectional view of the wind-resistant container system shown in FIG. 1A taken along line 1C-1C.

As shown in FIG. 1A through 1C, the container 102 can exhibit any suitable configuration. For example, in the illustrated embodiment, the container 102 may include a generally planar, rectangular bottom 110 (shown in FIG. 1C), front and back longitudinal side walls 112, 114, and a pair of opposite end walls 116. The front and back side walls 112, 114 may be connected to the bottom 110 and may extend generally upward therefrom. The end walls 116 may also be connected to the bottom 110 and may extend between the front and back side walls 112, 114. Together, the bottom 110, front and back side walls 112, 114, and end walls 116 may define a receiving space 118 (shown in FIG. 1C) with upper edges of the front and back side walls 112, 114, and end walls 116 defining an upper opening 120 into the receiving space 118. In the illustrated embodiment, the back side wall 114 may have a height generally equal to a height of the front side wall 112 such that the upper edges of the front and back side walls 112, 114, and end walls 116 are generally coplanar. Optionally, the container 102 can include one or more handle portions 122 (shown in FIG. 1B) for manipulation of the container 102. In an embodiment, the container 102 may be substantially rigid. In other embodiments, the container 102 may be substantially flexible.

Not only may the container's geometric configurations vary, but the container material may also vary from one embodiment to the next. For example, the container 102 may include plastic materials, thermoplastic materials, rubber materials, metal materials, woven fabrics, ceramic materials, cloth, bamboo, wood, canvas, composites, vinyl, combinations thereof, or any other suitable materials. In yet other embodiments, the container may include a metal or plastic frame within a plastic, rubber, or fabric body. In further embodiments, the container 102 may include one or more coats of waterproofing materials, stain resistant materials, deodorizing materials, combinations, thereof, or any other suitable material. Moreover, the container 102 may include any suitable number of layers. In an embodiment, the container 102 may include one or more insulating materials and/or heating materials. The insulating and/or heating materials may allow the container 102 to maintain trash or other items stored therein at a particular temperature. For example, in an embodiment, the container 102 may maintain trash stored therein at a temperature below about 85 degrees Fahrenheit, below about 80 degrees Fahrenheit, or below about 75 degrees Fahrenheit. Such a configuration may help reduce offensive odors that can emanate from some trash on a hot day.

In other embodiments, the container 102 can comprise any suitable, conventional container. For example, the container 102 can include, but is not limited to, a five-gallon bucket, a general tote, a storage locker, a bin, or the like. Of course, other containers may be employed for the container 102. Further, the container 102 may be formed via rotational molding, injection molding, laminating, extrusion molding, combinations thereof, or any other suitable technique.

While the container 102 is illustrated exhibiting a generally rectangular configuration, in other embodiments, the container 102 may exhibit a generally cylindrical configuration, a generally cubical configuration, a generally irregular geometric configuration, or any other suitable shape. In addition, while the bottom 110 is described being generally planar, in other embodiments, the bottom 110 may include one or more curved portions, one or more non-planar portions, planar and curved portions, combinations thereof, or any other suitable configuration. Moreover, while the upper edges of the front and back side walls 112, 114 and end walls 116 are illustrated being generally coplanar, in other embodiments, the upper edges of the front and back side walls 112, 114 and end walls 116 may be different from one another.

The system 100 may also include a lid 104 configured to selectively cover the opening 120 of the container 102. In an embodiment, the lid 104 and the back side wall 114 of the container may each include a pair of connectors that generally align with one another. Pin members 126 may then be inserted through bores extending through the connectors 127 to form a hinged connection. In an embodiment, the hinged connection may allow the lid 104 to be pivoted between a closed position (shown in FIG. 1B), wherein the lid 104 covers the opening 120, and an open position (shown in FIG. 1A), wherein the lid 104 is rotated away from the opening 120. The lid 104 may further include an upper surface 128 and a lower surface 130 configured to generally cover the opening 120 of the container 102 when the lid 104 is in the closed position.

While the lid 104 is illustrated being pivotally connected to the back side wall 114 of the container 102, in other embodiments, the lid 104 may be pivotally connected to the container 102 along the front side wall 112 or one or more of the end walls 116. Moreover, while the lid 104 is shown pivotally connected to the container 102 via a hinged connection, in other embodiments, the lid 104 may be removably attached to the container 102. For example, the lid 104 may be threadedly attached to the container 102. In other embodiments, the lid 104 may be attached to the container 102 via an interference fit, stitching, magnets, adhesives, hook and loop systems, or the like. In other embodiments, the lid 104 may be integrally formed on the container 102.

Optionally, the system 100 may include one or more features to help prevent wind or other forces from accessing the receiving space 118 of the storage container. For example, as shown in FIGS. 1A and 1C, the lower surface 130 of the lid 104 includes a recessed portion 132 and one or more of the upper edges of the front and back side walls 112, 114 and end walls 116 may include one or more raised portions 134. The one or more raised portions 134 may be configured to generally correspond to the one or more recessed portions 132 of the lid 104 such that when the lid 104 is in the closed position the one or more raised portions 134 are positioned within the one or more recessed portions 132. Such a configuration may help prevent wind or water from accessing the receiving space 118 of the container 102 by blocking passage of the same between the lid 104 and the container 102. In an embodiment, the one or more recessed portions 132 and one or more raised portions 134 may be configured to substantially form a seal between the lid 104 and the storage container 102 when the lid 104 is in the closed position. For example, the one or more raised portions 134 may include one or more compressible materials that compress when the one or more raised portions 134 are being positioned in the one or more recessed portions 132 and then expand within the one or more recessed portions 132 to form a seal between the lid 104 and the container 102.

In operation, at least a portion of the lower surface 130 of the lid 104 may be rotated away from the upper edge of the container 102 to move the lid 104 into the open position such that the upper opening 120 of the container 102 is accessible to a user, thereby, allowing a user to access the receiving space 118. With access to the receiving space 118, a user can add and/or remove trash or other materials from the receiving space 118. As shown in FIG. 1B, the lower surface 130 (shown in FIG. 1B) of the lid 104 may be rotated toward the upper edge of the container 102 to the closed position such that the lid 104 covers the opening 120. In the closed position, the one or more raised portions 134 of the container 102 may be positioned within the one or more recessed portions 132 of the lid 104. In an embodiment, the one or raised portions 134 may be configured to be at least partially secured within the one or more recessed portions 132. For example, the one or more recessed portions 132 of the lid 104 may form an interference fit with the one or more raised portions 134. In other embodiments, the one or more raised portions 134 may comprise a compressible structure that forms a seal between the lid 104 and the container 102 when positioned in the one or more recessed portions 13. In an embodiment, the one or more recessed portions 132 of the lid 104 may form a lock fit with the one or more raised portions 134. In other embodiments, one or more raised portions 134 may not be secured within said one or more recessed portions 132.

Such a configuration may form a barrier that substantially blocks the passage of any wind or water between the lid 104 and the upper edge of the container 102. For example, the one or more recessed portions 132 and the one or more raised portions 134 in the closed position of the lid 104 may form one or more tortuous paths for wind or water to enter the receiving space 118. Thus, the one or more raised portions 134 and the one or more recessed portions 132 can help prevent wind, water, or the like from entering the receiving space 118.

While one or more recessed portions 132 are illustrated in the lid 104 and the one or more raised portions 134 are illustrated formed on the upper edge of the container 102, in other embodiments, the one or more recessed portions 132 can be on the upper edge of the container 102 and the one or more raised portions 134 can be on the lower surface 130 of the lid 104. In yet other embodiments, the one or more recessed portions 132 and the one or more raised portions 134 can be on both the container 102 and the lid 104. In an embodiment, the one or more raised portions 134 can be attached to the upper edge of the container 102. In other embodiments, the one or more raised portions 134 can be integrally formed on the upper edge of the container 102. In an embodiment, the one or more raised portions 134 can comprise a single raised portion. In other embodiments, the one or more raised portions 134 can comprise a plurality of raised portions.

In other embodiments, the lid 104 may be configured to substantially form a seal between the lid 104 and the storage container 102 when the lid 104 is in the closed position. For example, in an embodiment, the lid 104 and/or the upper edge of the container 102 may include a compressible member (e.g., rubber or foam) configured to compress between the lid 104 and container 102 when the lid 104 is in the closed position to substantially form a seal therebetween. In other embodiments, the lid 104 and the upper edge of the container 102 may be configured as a closure element. For example, the lid 104 may form an interference fit with the upper edges of the container 102 when the lid is in the closed position. In an embodiment, the one or more raised portions 134 may exhibit an outer diameter that is slightly larger than an outer diameter of the one or more recessed portions 132 such that an interference fit is formed between the upper edge of the container 102 and the lid 104 when the lid 104 is in the closed position.

Figure 1D:
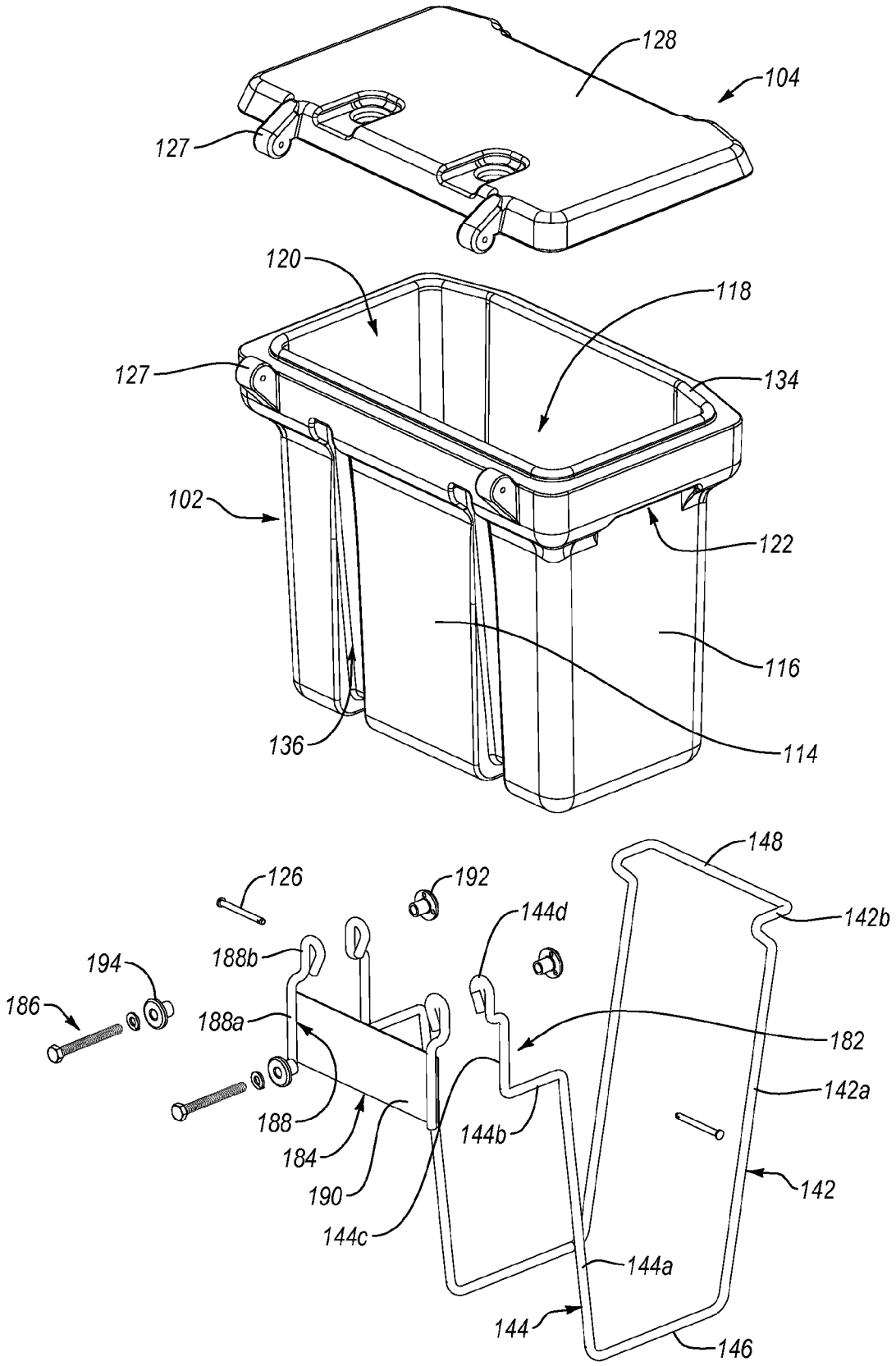
FIG. 1D is an exploded view of the wind-resistant container system shown in FIG. 1A.

Referring now FIGS. 1C and 1D, the system 100 can include a support system 106. In an embodiment, the support system 106 can comprise a wire frame support system including two bottom arms 146, two front arms 142, and two back arms 144. In the illustrated embodiment, the bottom arms 146 may be positioned and configured to extend across the bottom 110 of the container 102. The front arms 142 may be connected to a first end of the bottom arms 146 and may extend generally upward therefrom. In an embodiment, the front arms 142 are configured to contact or engage at least a portion of the front side wall 112 of the container 102. The back arms 144 may be connected to a second end of the bottom arms 146 and may extend generally upward therefrom. The back arms 144 can be configured to engage at least a portion of the back side wall 114 of the container 102. Accordingly, the front arms 142, the back arms 144, and the bottom arms 146 may form a skeletal structure configured to retain and/or cradle the container 102 between the front arms 142 and the back arms 144. The support system 106 may be any suitable support system. For example, the support system 106 can be a dedicated support system configured to hold a dedicated container. In other embodiments, the support system 106 can be a universal support system configured to hold a number of containers having varying sizes and/or shapes. While the support system 106 is described as a wire frame support system, in other embodiments, the support system 106 may comprise a rigid exterior casing, a flexible exterior casing, a mesh support system, a brace system, combinations thereof, or any other suitable support system.

The support system 106 may be formed of any suitable materials. For example, in an embodiment, one or more portions of the support system 106 may be formed of tubular steel members, plastic materials, composite materials, combinations thereof, or other suitable materials. Moreover, the support system 106 may exhibit a variety of different suitable configurations. For example, in an embodiment, one or more portions of the support system 106 may exhibit a diameter between about 0.25 inches and about 0.5 inches (e.g., 0.301 inches). In other embodiments, one or more portions of the support system 106 may exhibit a larger or smaller diameter. In other embodiments, the front arms 142, the back arms 144, and the bottom arms 146 may exhibit varying diameters. In other embodiments, one or more portions of the support system 106 may exhibit a generally round, cross-sectional shape. In other embodiments, one or more portions of the support system 106 may exhibit a square, rectangular, hexagonal, or any other suitable cross-sectional shape. In yet other embodiments different portions of the support system 106 may exhibit different cross-sectional shapes. While the support system 106 is shown and described including two bottom arms, two front arms, and two back arms, in other embodiments, the support system 106 can include one, three, four, five, combinations thereof, or any other suitable number of front arms 142, back arms 144, or bottom arms 146. Moreover, in other embodiments, the support system 106 can include other arms in addition to the back, front, and bottom arms 142, 144, 146. For example, in an embodiment, the support system 106 can include one or more side arms extending between the front arms 142 and the back arms 144. The side arms may be configured to engage the end walls 116 and/or retain the container 102 between the front arms 142 and the back arms 144. In an embodiment, the side arms may be generally u-shaped. The front arms 142, the back arms 144, and/or the bottom arms 146 may include a plurality of members connected to one another. In other embodiments, the front arms 142, the back arms 144, and the bottom arms 146 may comprise a single member.

In the illustrated embodiment, the support system 106 may be configured such that the front arms 142 and/or the back arms 144 bend to some degree when the container 102 is placed in the support system 106 such that the front arms 142 and/or back arms 144 resiliently apply a compressive holding force on the container 102. Such a configuration may securely hold the container 102 within the support system 106 as the front arms and/or back arms 142, 144 squeeze or press on the container 102.

Not only can the support system 106 be configured to securely hold the container 102, in an embodiment, the container 102 and the support system 106 may also be configured to help stabilize the overall system 100 and/or secure the system 100 on a wall or other structure. For example, the container 102 may include one or more guides 136 configured to receive and/or position the front arms 142, the back arms 144, and/or the bottom arms 146 of the support system 106 on the container. As shown, guides 136 are formed in the front side wall 112, the back side wall 114, and the bottom 110 of the container 102. The one or more guides 136 can align the container 102 over the front arms 142, back arms 144, and/or bottom arms 146 such that the container 102 is balanced when it is on the support system 106. In another embodiment, the one or more guides 136 can help hold the container 102 on the support system 106. For example, when the container 102 is placed in the support system 106 and the front arms 142, back arms 144, and/or the bottom arms 146 are positioned in the one or more guides 136, the guides 136 can help limit vertical, horizontal, and/or rotational movement of the container 102.

The size, length, and/or geometric configuration of the guides 136 may be selected to help stabilize the container 102 on the support system 106. For example, the upper portion of the container 102 may include a flange region exhibiting a thickness that is greater than a lower portion of the container. As shown in FIG. 1D, the one or more guides 136 may have a length that extends along the back side wall 114 and terminates in the flange region of the container. Such a configuration may form a shoulder portion or stop where the one or more guides 136 terminate in the back side wall 114. Thus, when the back arms 144 are positioned in the one or more guides 136, physical engagement between the back arms 144 and the shoulder portions of the one or more guides 136 may help limit movement of the container 102 relative to the support system 106. In other embodiments, the guides 136 may exhibit a selected width that is less than an outer diameter of the front arms 142, the back arms 144, and/or the bottom arms 146 such that the arms can be snapped or selectively locked in the guides 136. Moreover, while the guides 136 are described as grooves are described, in other embodiments, the guides 136 may comprise slots, slits, recessed portions, clips, snaps, magnets, combinations thereof, or any other suitable feature. Further, the guides 136 may be formed on any portion of the container 102. For example, the guides 136 can be formed on the front side wall 112, the back side wall 114, and/or the end walls 116.

Each front arm 142 may include a lower portion 142*a* and an upper portion 142*b*. As shown in FIG. 1D, the lower portion 142*a* may extend generally upward from the first end portion of the base arm 146. The lower portion 142*a* may be generally linear. In other embodiments, the lower portion 142*a* may be curved. In other embodiments, the lower portion 142*a* may include linear and curved portions. In yet other embodiments, the lower portion 142*a* may include one or more angled portions. For example, the lower portion 142*a* may be generally diamond-like. The upper portion 142*b* may be connected to an upper end region of the lower portion 142*a*. In an embodiment, the upper portion 142*b* may include one or more portions positionable on and/or over the lid 104 of the container 102. For example, the upper portion 142*b* may include an angled or bent section exhibiting a reverse 7-like profile. In other embodiments, the upper portion 142*b* may exhibit a u-like shape, a v-like shape, an s-like shape, a w-like shape, a three-dimensional curved shape (e.g., helical), a sinusoidal shape, or any other suitable shape.

The upper portions 142*b* of the front arms 142 may be configured as closure elements that secure the lid 104 in the closed position. For example, the upper portions 142*b* can be selectively positioned on and/or over the upper surface 128 of the lid 104 to secure the lid 104 in the closed position. In an embodiment, the front arms 142 may resiliently bias the upper portions 142*b* onto the upper surface 128 of the lid 104. Such a configuration may help prevent wind, animals, children and/or the like from accessing the receiving space 118 of the container 102 when the lid 104 is in the closed position. For example, wind traveling between the lid 104 and the container 102 can have the tendency to exert upward forces against the lower surface 130 of the lid 104. Such forces could potentially blow the lid 104 into the open position. By resiliently positioning the upper portions 142*b* of the front arms 142 over upper surface 128 of the lid 104, the upper portions 142*b* of the front arms 142 can physically impede upward movement of the lid 104 to secure the lid in the closed position.

In an embodiment, the angle of the angled or bent portion of the upper portion 142*b* may be selected to control the force exerted on the lid 104 by the upper portion 142*b*. For example, the angle formed between lower surfaces of the upper portions 142*b* may be between about zero degrees and about sixty degrees; about ten degrees and about fifty degrees, or about thirty degrees and about fifty-five degrees relative to an imaginary horizontal line. Optionally, the lid 104 may include a seat portion 133 configured to selectively engage the upper portions 142*b* of the front arms 142. In an embodiment, the support structure 106 may include a handle portion 148 extending between the upper portions 142*b* of the front arms 142. Such a handle portion 148 may be used to carry the system 100 and/or manipulate the upper portions 142*b* of the front arms 142 as described in more detail below. In an embodiment, the handle portion 148 may be generally linear. In other embodiments, the handle portion 148 may be curved and/or linear. In yet other embodiments, the handle portion 148 may include one or more grip portions configured to correspond to the user's hand grasping the handle portion 148. Moreover, in other embodiments, the flange region of the container 102 may be sized and configured to selectively position the upper portions 142*b* on and/or over the lid 104. For example, the flange region of the container 102 may be configured and angled to direct the front arms 142 of the support system 106 away from the storage container 102 such that the front arms 142 are at least partially flexed and the upper portions 142*b* resiliently engage the lid 104.

In operation, a user may grasp the handle portion 148 to bend, flex, or rotate the front arms 142 away from the container 102. As the user moves the front arms 142 away from the container 102, the upper portions 142*b* of the front arms 142 can disengage or pull away from the lid 104, thereby, allowing the lid 104 to be freely moved between the closed and open positions (shown in FIG. 1A) by the user. To selectively secure the lid 104 in the closed position, the user may grasp the handle portion 148 to move the upper portions 142*b* of the front arms 142 away from the lid 104. The user can then move the lid 104 into the closed position. After moving the lid into the closed position, the user can release the handle portion 148 so that the front arms 142 resiliently bias the upper portions 142*b* of the front arms 142 back toward the lid 104. In an embodiment, the front arms 142 can bias the upper portions 142*b* onto the lid 104 as shown in FIG. 1A. In other embodiments, the front arms 142 can bias the upper portions 142*b* over the lid. With the upper portions 142*b* biased onto and/or on the upper surface 128 of the lid 104, the lid 104 can be secured in the closed position. Thus, the system 100 can help protect contents within the receiving space 118 of the container 102 from wind, precipitation, or the like.

While the closure elements are shown as the upper portions 142*b* of the front arms 142, other closure elements are possible such as adhesives, magnets, buttons, snaps, Velcro® (a hook and loop type closure system), clasps, a pad lock, latch systems, combinations thereof, or any other suitable closure element. In addition, in other embodiments, the closure elements can be formed on the handle portion 148 of the support system 106.

Referring still to FIG. 1D, each back arm 144 may include a lower portion 144*a*, a first intermediate portion 144*b*, a second intermediate portion 144*c*, and an upper loop 144*d*. The lower portion 144*a* may extend generally upward from the second end portion of the base arm 146. In an embodiment, the lower portion 144*a* may be generally linear, curved, or combinations thereof. The first intermediate portion 144*b* may be connected to an upper end region of the lower portion 144*a*. In an embodiment, the first intermediate portion 144*b* may extend at an angle relative to the lower portion 144*a*. For example, in an embodiment, the first intermediate portion 144*b* may form an angle between about ninety degrees and about one-hundred seventy five degrees; about ninety-five degrees and about one-hundred thirty five degrees; or about ninety-five degrees and about one-hundred and twenty degrees relative to the lower portion 144*a*. In an embodiment, the first intermediate portion 144*b* may extend generally parallel to the base arm 146. In other embodiments, the first intermediate portion 144*b* may extend generally non-parallel to the base arm 146. The length of the first intermediate portion 144*b* may be selected to help provide clearance or space between the hinged connection of the lid 104 and the container 102 and a wall or other structure to which the system 100 is secured. For example, in the illustrated embodiment, the first intermediate portion 144*b* may exhibit a length that extends beyond the connectors of the lid 104. In addition, a portion of the first intermediate portion 144*b* may engage the shoulder portion of the groove 136 formed in the back side wall 114 of the container. Such a configuration may help maintain the position of the container 102 on the support system 106.

Referring still to FIG. 1D, the second intermediate portion 144*c* may extend generally upward from an end portion the first intermediate portion 144*b*. In an embodiment, the second intermediate portion 144*c* may exhibit an inverted L-like profile. For example, the second intermediate portion 144*c* may include a lower section extending generally upward and an upper section connected to and forming an angle relative to the lower section. In an embodiment, the lower section of the second intermediate portion 144*c* may form an angle of about ninety degrees relative to the upper section of the second intermediate portion 144*c*. In other embodiments, the lower section of the second intermediate portion 144*c* may form an angle between about eighty degrees and about one hundred seventy-five degrees; about ninety-five degrees and about one hundred thirty-five degrees; or about ninety-five degrees and about one hundred and twenty-degrees relative to the upper section of the second intermediate portion 144*c*. It will be appreciated that the lower section of the second intermediate portion 144*c* may form a larger or smaller angle relative to the upper section of the second intermediate portion 144*c*.

In an embodiment, the lower section and/or upper section of the second intermediate portion 144*c* may be substantially linear, curved, combinations thereof, or the like. For example, in an embodiment, the lower section of second intermediate portion 144*c* may comprise a wave-like section. As discussed in more detail below, one or more portions of the lower section of second intermediate portion 144*c* may form a clamping surface that is positionable on a front surface and/or a back surface of a wall or other structure. In an embodiment, the loop portion 144*d* may be connected to the upper section of the second intermediate portion 144*c*. The upper section (e.g., substantially horizontal or non-vertical section) the second intermediate portion 144*c* may form a stop or shoulder configured to rest on an upper surface of a wall. Such a wall may include, but is not limited to, a tailgate, a front wall, or a side wall of a truck. Such a shoulder can help stabilize the system 100 on the wall and/or limit movement of the system 100 relative to the wall. In the illustrated embodiment, the loop portion 144*d* may include a through-hole. The loop portion 144*d* may extend generally upward from the upper section of the second intermediate portion 144*c*. It will be appreciated that the loop portion 144*d* may be omitted. For example, a bar member including a through-hole may be attached to the upper section of the second intermediate portion 144*c*.

The anchoring system 108 may exhibit any suitable configuration. In an embodiment, the anchoring system 108 may comprise a clamping system including a fixed portion 182 and a movable portion 184. The fixed portion 182 may include a first clamping surface 183 and the movable portion 184 may include a second clamping surface 185 that can be substantially parallel the first clamping surface 183. In other embodiments, the second clamping surface 185 may be non-parallel the first clamping surface 183.

The movable portion 184 can be movable relative to the fixed portion 182 via any suitable means. Such a configuration allows the anchoring system 108 to be adaptable or selectively sized to fit onto walls or other structures of varying sizes at least in part because the distance between the fixed portion 182 and the movable portion 184 is adjustable.

In the illustrated embodiment, the movable portion 184 can be movable relative to the fixed portion 182 via a pair threaded members 186 extending between the movable portion 184 and the fixed portion 182. The threaded members 186 may include a threaded shaft portion attached to a head portion. In an embodiment, the threaded members 186 may be interchangeable. For example, if the system 100 is being used on a thicker wall, a longer pair of threaded members 186 may be utilized. If the system 100 is being used on a thinner wall, a shorter pair of threaded members 186 may be utilized. While the anchoring system 108 is described including threaded members, in other embodiments, the anchoring system 108 can include one or more levers, cams, or the like to move the movable portion 184. Further, while the anchoring system 108 is illustrated including two threaded members, in other embodiments, the anchoring system 108 may include one, three, five, or any other suitable number of threaded members. Moreover, while the movable portion 184 is described as being movable toward and/or away from the fixed portion 182, in other embodiments, the fixed portion 182 may be movable toward and/or away from the movable portion 184. In yet other embodiments, the fixed portion 182 and the movable portion 184 may both be movable relative to one another.

In an embodiment, the fixed portion 182 may comprise the second intermediate portions 144*c* and the loop portions 144*d* of the back arms 144. A portion of the second intermediate portions 144*c* may form the first clamping surface 183. In other embodiments, a plate member may extend between the second intermediate portions 144*c* of the back arms 144 to form the first clamping surface 183. In an embodiment, the first and/or second clamping surface 183, 185 may comprise a hard and/or soft surface. For example, the first and/or second clamping surface 183, 185 may include one or more cushioning materials.

The movable portion 184 of the anchoring system 108 may include a pair of support arms 188 and a plate member 190 extending between the support arms 188. In an embodiment, the plate member 190 can form the second clamping surface 185. The plate member 190 may exhibit any suitable configuration. For example, the plate member 190 may be generally planar. In other embodiments, the plate member 190 may be curved. In other embodiments, the plate member 190 may exhibit an accordion-like configuration.

The support arms 188 may include a lower portion 188*a* and an upper loop portion 188*b* that is connected to the lower portion 188*a*. In an embodiment, the lower portion 188*a* may exhibit an inverted L-like profile. For example, the lower portion 188*a* may include a lower section extending generally upward and an upper section connected to and forming an angle relative to the lower section. In an embodiment, the lower section of the lower portion 188*a* may form an angle of about ninety degrees relative to the upper section of the lower section of the lower portion 188*a*. In an embodiment, the lower section of the lower portion 188*a* may form an angle of about ninety degrees relative to the upper section of the lower portion 188*a*. In other embodiments, the lower section of the lower portion 188*a* may form an angle between about eighty degrees and about one hundred seventy-five degrees; about ninety-five degrees and about one hundred thirty-five degrees; or about ninety-five degrees and about one hundred and twenty-degrees relative to the upper section of the lower portion 188*a*. It will be appreciated that the lower section of the lower portion 188*a* may form a larger or smaller angle relative to the upper section of the lower portion 188*a*.

In an embodiment, the plate member 190 may be attached to the lower portions 188*a* of the support arms 188. The upper loop portion 188*b* of each support arm 188 may include a through-hole. While the movable portion 184 is described including the plate member 190, in other embodiments the plate member 190 may be omitted. For example, in an embodiment, a portion of the lower portions 188*a* of the support arms 188 may form the second clamping surface 185.

As shown in FIGS. 1A and 1D, the threaded members 186 may extend through the through-holes of the upper loop portions 144*d* of the back arms 144 and upper loop portions 188*b* of the support arms 188. In an embodiment, the movable portion 184 and/or the fixed portion 182 may be threadedly engaged with the threaded members 186 such that rotation of the threaded members 186 moves the movable portion 184 toward or away from the fixed portion 182.

For example, in an embodiment, the system 100 may include a pair of fixed portion annular members 192. Each fixed portion annular member 192 can include a hollow, cylindrical body and a flange extending radially outward from the cylindrical body. The cylindrical body can be sized and configured to be inserted within the through-holes of the upper loop portions 144*d* of the back arm 144 and to span at least the length thereof to help support the threaded member 186. Such a configuration may help create a more stable connection between the threaded members 186 and the fixed portion 182. In an embodiment, the cylindrical body of the fixed portion annular member 192 may include an internally threaded receptacle configured to receive the threaded member 186. In particular, the threaded member 186 can include external threads configured to engage internal threads of the internally threaded receptacle of the cylindrical body of the fixed portion annular member 192. The flange of the fixed portion annular member 192 may provide a surface that engages the upper loop portions 144*d* to help maintain the position of the fixed portion annular member 192 within the upper loop portions 144*d*.

The fixed portion annular members 192 can be secured within the upper loop portions 144*d* of the back arms 144 in any suitable manner. For example, one or more of the fixed portion annular members 192 may be secured within the upper loop portions 144*d* via welding. In other embodiments, the cylindrical body of one or more of the fixed portion annular members 192 can be configured to have a press fit engagement with the through-holes of the upper loop portions 144*d*. In yet other embodiments, the fixed portion annular members 192 may be secured within the through-holes of the upper loop portions 144*d* via adhesives, mechanical fasteners, combinations thereof, or any other suitable technique. In yet other embodiments, the fixed portion annular members 192 may be removably positioned within the through-holes of the upper loop portions 144*d*. In an embodiment, one or more of the fixed portion annular member 192 may comprise a flange weld nut. In other embodiments, one or more of the fixed portion annular members 192 may comprise a hollow cylindrical body without a flange, a hollow hexagonal body, a nut, a bushing, a sleeve, or any suitable type of annular member.

In an embodiment, the system 100 may further include a pair of movable portion annular members 194. Each movable portion annular member 194, similar to the fixed portion annular members 192, can include a hollow, cylindrical body and a flange extending radially outward from the cylindrical body. The cylindrical body of the movable portion annular member 194 can be sized and configured to be inserted in the through-holes of the upper loop portions 188*b* of the support arms 188 and to span at least the length thereof to help support the threaded member 186. Such a configuration may help create a more stable connection between the threaded members 186 and the movable portion 184. In an embodiment, the cylindrical body of the movable portion annular member 194 can include a slip-type or non-threaded internal receptacle configured to slidably receive the threaded member 186. The flange of the movable portion annular member 194 may provide a surface that engages the upper loop portions 188*b* to help maintain the movable portion annular members 194 within the through-holes and/or to help move the movable portion 184 toward the fixed portion 182. Like the fixed portion annular members 192, the movable portion annular members 194 may be secured within the through-holes of the upper loop portions 188*b* via any suitable means. In other embodiments, the movable portion annular members 194 may be removably positioned within the through-holes of the upper loop portions 188*b*.

While the support arms 188 and back arms 144 are described including loop portions, in other embodiments, the support arms 188 and/or the back arms 144 may include through-holes formed directly therein. In yet other embodiments, the support arms 188 and/or the back arms 144 may not include loop portions or through-holes. For example, the threaded members 186 may extend between bracket members attached to the support arms 188 and/or the back arms 144.

In an embodiment, the threaded members 186 may be inserted through the slip-type receptacles of the movable portion annular members 194 and threadedly engaged with the internally threaded receptacles of the fixed portion annular members 192. When the threaded members 186 are rotated in a first direction, engagement between the threaded members 186 and the internally threaded receptacles of the fixed portion annular members 192 and engagement between the flange portion of the movable portion annular members 194 and the upper loop portions 188*b* of the support arms 188 may move the movable portion 184 toward the fixed portion 182. When the threaded members 186 are rotated in a second direction, the threaded members 186 may move the movable portion 184 away from the fixed portion 182. Accordingly, a user can adjust and/or control the distance between the movable portion 184 and the fixed portion 182 by rotating the threaded members 186. Optionally, the system 100 may include one or more lock washers to help maintain the threaded members 186 in a desired position.

While the fixed portion annular members 192 are described including internally threaded receptacles and the movable portion annular members 194 are described including a slip-type receptacles, in other embodiments, the fixed portion annular members 192 may include slip-type receptacles and the movable portion annular members 194 may include internally threaded receptacles.

In addition to moving the movable portion 184 relative to the fixed portion 182, the threaded members 186, the fixed portion annular members 192, and/or the movable portion annular members 194 may help maintain the first clamping surface 183 of the fixed portion 182 substantially parallel to the second clamping surface 185 of the movable portion 184. For example, the combination of the threaded members 186, the fixed portion annular members 192, and the movable portion annular members 194 may form a substantially rigid connection between the fixed portion 182 and the movable portion 184 such that the first and second clamping surfaces 183, 185 remain substantially parallel as the movable portion 184 moves relative to the fixed portion 182. Such a configuration can help limit rotational movement of the movable portion 184 relative to the fixed portion 182.

In operation, a user may position the movable portion 184 and the fixed portion 182 of the anchoring system 108 over a structure. The structure may include a back wall of a truck. In other embodiments, the wall may include a side wall of a truck, a boat wall, a decorative wall, a retaining wall, a dividing wall, or any other suitable type of wall or structural member such as a vertical tubular post, a tubular frame, or aftermarket vehicle add on. For example, in an embodiment, the movable portion 184 and the fixed portion 182 of the anchoring system 108 may be rotated about ninety degrees relative to the container 102 and/or the support system 106 such that the system 100 may be attached on a vertical post or a vertical structural member.

The second intermediate portions 144*c* of the back arms 144 may be positioned on the wall such that the first clamping surface 183 engages the front surface of the wall. Optionally, the upper section of the second intermediate portion 144*c* may be positioned on an upper surface of the wall such that the second intermediate portion 144*c* substantially prevents downward movement of the system 100 relative to the wall. Moreover, the second intermediate portion 144*c* may function to help resist or counter rotation of the anchoring system 108. For example, the second intermediate portion 144*c* may help maintain the anchoring system 108 in a generally upright position by bracing the anchoring system 108 against the upper surface of the wall with the upper section and against a front surface of the wall with the lower section when one or more forces attempt to rotate the anchoring system 108 toward and/or way from the container 102 or side to side.

In an embodiment, the threaded members 186 may then be rotated in a first direction to move the movable portion 184 toward the front surface of the wall until the second clamping surface 185 of the movable portion 184 engages the front surface of the wall. The user may then continue to rotate the threaded members 186 in the first direction until the wall is clamped between the first clamping surface 183 of the fixed portion 182 and the second clamping surface 185 of the movable portion 184. In an embodiment, the upper section of the lower portion 188*a* of the support arms 188 may be positioned on the upper surface of the wall such that the upper section of the lower portion 188*a* forms a stop or shoulder that substantially prevents downward movement of the system 100 relative to the wall. In an embodiment, the lower portion 188*a* may also be configured to help resist or counter rotation of the anchoring system 108. For example, the lower portion 188*a* may help maintain the anchoring system 108 in a generally upright position by bracing the anchoring system 108 against the upper surface of the wall with the upper section of the lower portion 188*a* and against the back surface of the wall with the lower section of the lower portion 188*a* when one or more forces attempt to rotate the anchoring system 108 toward and/or away from the container 102 or side to side.

As shown, the plate member 190 and the lower sections of the second intermediate portions 144*c* may be substantially parallel when the anchoring system 108 is anchored on the wall. The clamping forces exerted on the wall by the plate member 190 and the lower sections of the second intermediate portions 144*c* of the back arms 144 may be substantially parallel relative to one another such that the clamping forces of the anchoring system 108 do not tend to push the anchoring system 108 upward off the wall. Thus, the system 100 can be conveniently and securely anchored to wall without the need of making permanent modifications to the wall. Moreover, because of the adjustability of the anchoring system 108, the system 100 may be attached to walls of varying configurations.

In addition, it will be appreciated that the system 100 may be anchored to any suitable location on the wall. For example, in an embodiment, the first clamping surface 183 of the fixed portion 182 may be positioned on the front surface of the wall and the second clamping surface 185 of the movable portion 184 may be positioned on the back surface of the wall. In an embodiment, the anchoring system 108 and/or the container 102 may be configured such that when the system 100 is anchored to the wall, the uppermost portion of the container 102 is below the upper surface of the wall. As a result, the system 100 may utilize the height of the wall as an additional barrier against wind, rain and other forces. In other embodiments, the anchoring system 108 and/or the container 102 may be configured such that when the system 100 is anchored to the wall the uppermost portion of the container 102 is above the upper surface of the wall.

To remove the system 100 from the wall, the threaded members 186 may be rotated in a second direction to move the movable portion 184 away from the front portion of the wall until the second clamping surface 185 and/or the first clamping surface 183 disengages from the wall. With one or more of the clamping surfaces disengaged from the wall, the user may simply lift the system 100 off of the wall.

While the anchoring system 108 is described engaging the front and back surfaces of the wall, in other embodiments, the anchoring system 108 may be configured to engage other surfaces of the wall and/or other surfaces. For example, the anchoring system 108 may be configured to engage a front surface of the wall and a surface within a tie down anchor formed in the upper surface of the wall. In other embodiments, the anchoring system 108 may be configured to engage a surface within a drain port formed in the bottom of the truck bed.

Optionally, the system 100 may include one or more features configured to help protect paint, clear coats, and/or other finishes on the wall. For example, in an embodiment, one or more portions of the support system 106 and/or the anchoring system 108 may include one or more padded portions that protect the wall. In other embodiments, one or more portions of the support system 106 and/or the anchoring system 108 may be dipped, sprayed and/or coated with a protective material that protects the wall from scratching or other surface damages. In an embodiment, the protective material may comprise a rubber material, a blast coat material, or any other suitable material.

As demonstrated above, the system 100 can conveniently and safely store trash, fishing tackle, tools, keys, gloves, and/or other items in the receiving space 118 of the container 102 within truck beds, boat decks, and other areas frequently exposed to high winds. In addition, the system 100 is adaptable such that it can be anchored to walls or other structures of varying sizes. Further, the system 199 can be anchored to walls or other structures without the need of making permanent modifications in the wall or other structure.

Figure 2A:
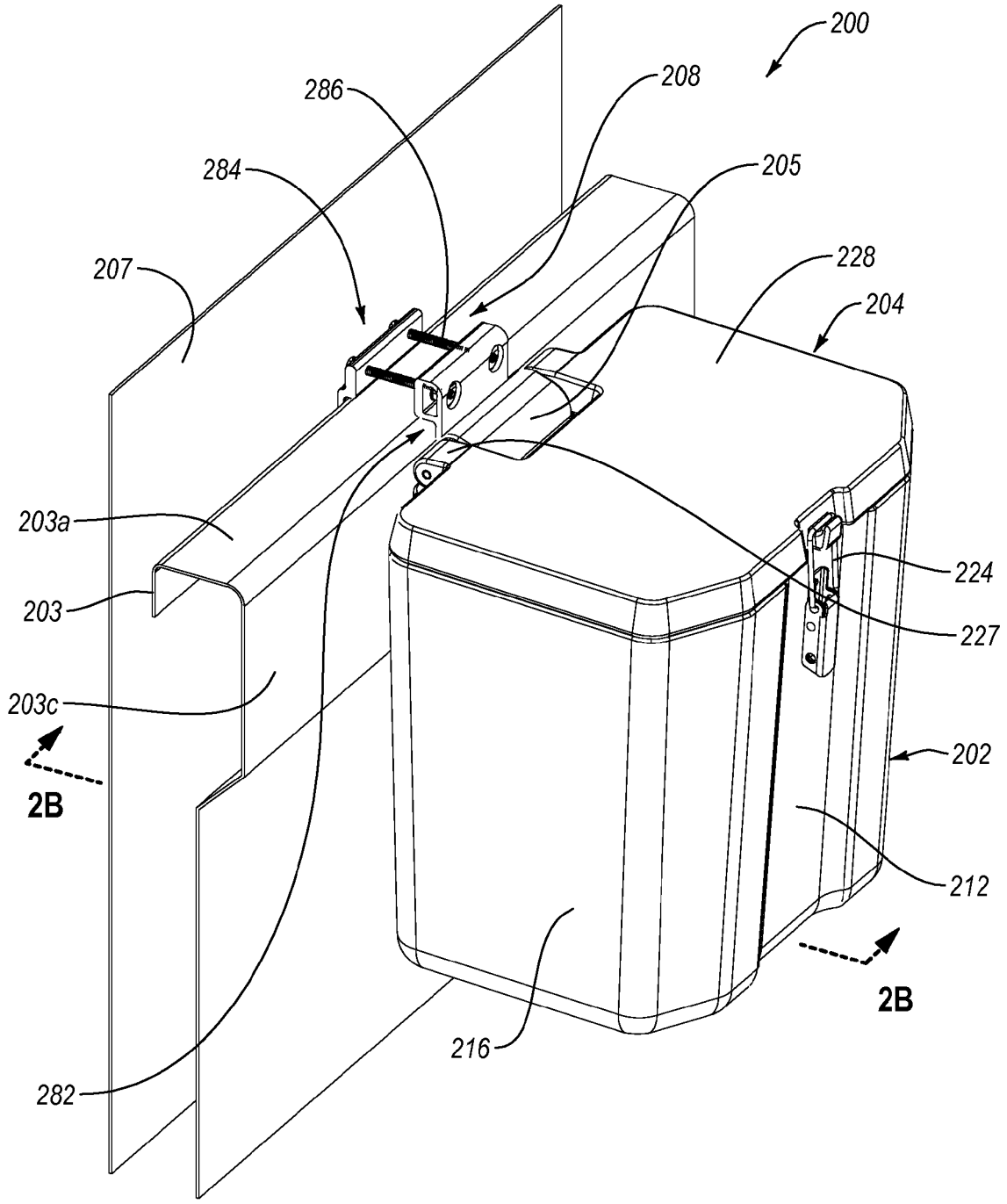
FIG. 2A is an isometric view of a wind-resistant container system according to another embodiment.
Figure 2B:
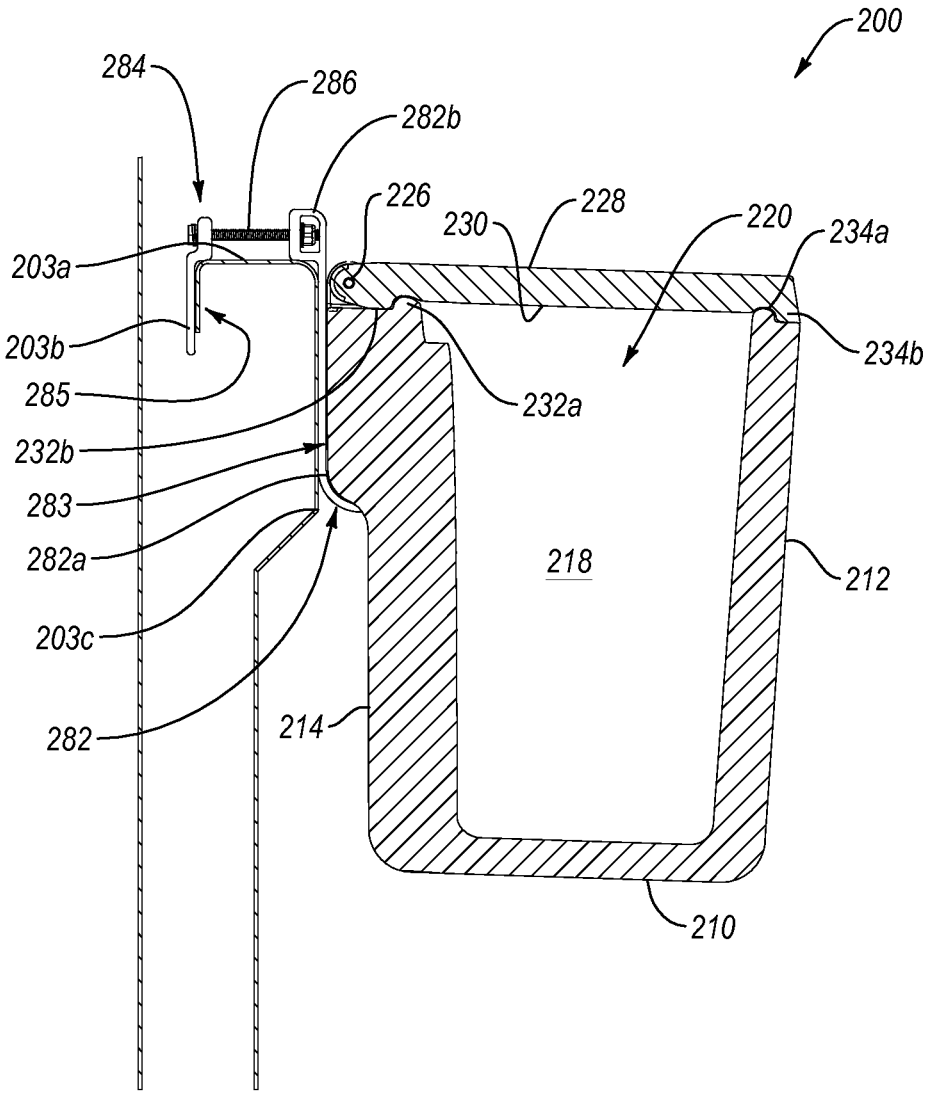
FIG. 2B is a cross-sectional view of the wind-resistant container system shown in FIG. 2A taken along line 2B-2B.
Figure 2C:
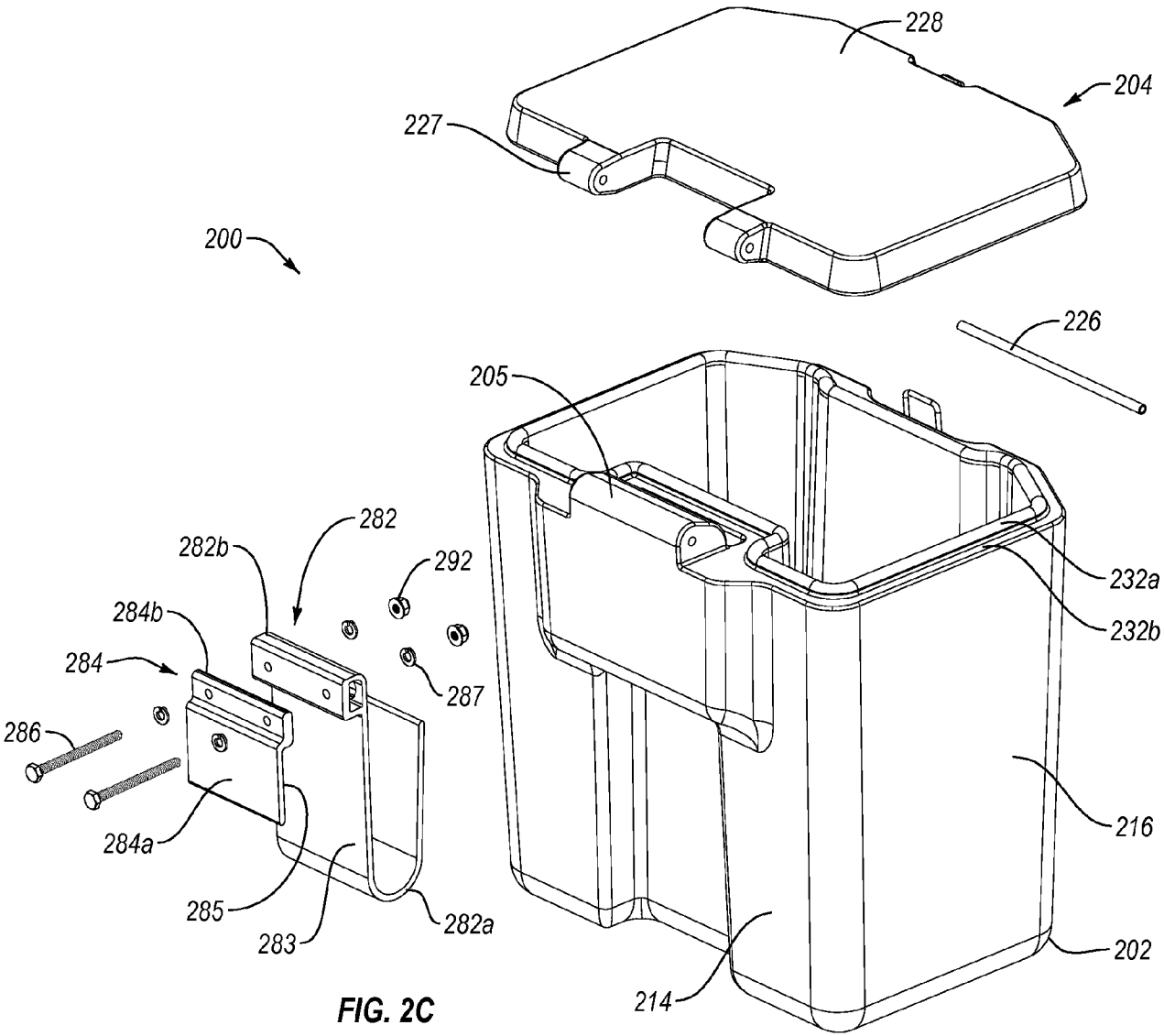
FIG. 2C is an exploded view of the wind-resistant container system shown in FIG. 2A.

In other embodiments, the support system may be omitted. For example, FIGS. 2A through 2C illustrate a wind-resistant container system 200 according to another embodiment. The system 200 includes many of the same components as the system 100 shown in FIGS. 1A through 1D. Therefore, in the interest of brevity, components of the system 200 that are identical or similar to each other have been provided with the same reference numerals, and an explanation of their structure and function will not be repeated unless the components function differently in the system 100. However, it should be noted that the principles of the system 200 can be employed with any of the embodiments described with respect to FIGS. 1A through 1D.

The wind-resistant container system 200 can include a container 202, a lid 204, and an anchoring system 208. Similar to the container 102, the container 202 can exhibit any suitable configuration. For example, the container 202 may include a bottom 210, front and back longitudinal side walls 212, 214, and a pair of opposite end walls 216. The front and back side walls 212, 214 may be connected to the bottom 210 and may extend generally upward therefrom. The end walls 216 may also be connected to the bottom 210 and may extend between the front and back side walls 212, 214. Together, the bottom 210, front and back side walls 212, 214 and end walls 216 may define a receiving space 218 (shown in FIG. 2B) with upper edges of the front and back side walls 212, 214, and end walls 216 defining an opening 220 into the receiving space 218. The container 202 may be formed of any suitable material. For example, the container 202 may include plastic materials, thermoplastic materials, rubber materials, metal materials, woven fabrics, ceramic materials, cloth, combinations thereof, or any other suitable materials. In an embodiment, the container 202 can be a dedicated container. In other embodiments, the container 202 can be any suitable conventional container. In an embodiment, the container 202 may exhibit a generally rectangular configuration. In other embodiments, the container 202 may exhibit a generally cubical configuration, a generally cylindrical configuration, or any other suitable shape.

The system 200 may further include a lid 204 configured to selectively cover the opening 220 of the container 202. The lid 204 may include an upper surface 228 and a lower surface 230. The lid 204 may be pivotally connected to the container 202. For example, the lid 204 may include a pair of connectors 227 and a mounting member 205 positionable between the connectors 227. In an embodiment, the mounting member 205 may include a portion configured to engage or connect to a portion of the anchoring system 208. For example, the mounting member 205 may include a curved lower surface. In an embodiment, the mounting member 205 may include a generally elliptical, generally oval, or any other suitable curved lower surface.

In an embodiment, a pin member 226 may be inserted through a bore extending through the connectors and the mounting member 205 to form a hinge or hinged connection between the lid 204 and the mounting member 205. The hinged connection may allow the lid 204 to be movable between a closed position (shown in FIG. 2B), wherein the lid 204 covers the opening 220, and an open position, wherein the lid 204 is rotated away from the opening 220. In an embodiment, the mounting member 205 may be connected to the container 202. A gap or channel may extend between the mounting member 205 and back side wall 214 of the container 202. The gap may be configured to receive a portion of the anchoring system 208.

Optionally, the lower surface 230 of the lid 204 and/or the upper edge of the container 202 may include one or more features configured to help protect the receiving space 218 of the container 202. In an embodiment, a portion of the lower surface 230 of the lid may be configured to extend below a portion of the upper edge of the container 202. For example, the lid 204 may include one or more raised portions 234*b* and one or more recessed portions 234*a*. The upper edge of the container may include one or more seat portions 232*b* that are positioned and configured to generally correspond to the annular raised portions 234*b* of the lid 204 when the lid 204 is in the closed position. In addition, the upper edge of the container 202 may include one or more raised portions 232*a* that are positioned and configured to generally correspond to the recessed portions 234*a* of the lid 204 when the lid 204 is in the closed position. Such a configuration can form tortious paths for wind and rain to pass between the lid 204 and the container 202 and into the receiving space 218. According, the lid 204 can help protect trash and/or other materials stored in the container 202 from wind, sunlight, precipitation, and/or other elements of nature. Moreover, such a configuration can help limit vertical and/or horizontal movement of the lid 204 in the closed position.

In other embodiments, the upper edge of the container 202 and the lid 204 may be configured as a closure element to help secure the lid 204 in the closed position. For example, the outer diameter of the raised portion 232*a* of the storage container 202 may be slightly larger than the inner diameter of the raised portion 234*b* of the lid 204 such that the lid 204 forms an interference fit with the container 202 when the lid 204 is in a closed position.

As shown in FIG. 2A, the system 200 may include one or more closure elements configured to selectively secure the lid 204 in the closed position. For example, the system 200 may include a closure element comprising latch system 224 attached to the front side wall 212 of the container 202 and the lid 204. The latch system 224 may comprise a steel latch, a rubber latch, a plastic latch, combinations thereof, or any other suitable latch. The latch system 224 allows the lid 204 to be selectively locked in the closed position, thereby helping to protect contents stored in the receiving space 218 of the container 202. While the closure element is shown as a latch system, other closure elements are possible such as adhesives, magnets, buttons, snaps, hook and loop type closure systems, combinations thereof, or any other suitable closure element. Furthermore, while the latching system is shown on the front of the system 200, in other embodiments, the latching system may be positioned on the ends of the system 200. In yet other embodiments, the latching system may be positioned on the front and ends of the system 200.

The anchoring system 208 may exhibit any suitable configuration and may be configured to help anchor the system 200 on a wall and/or other structure. For example, the anchoring system 208 may comprise a clamping system including a fixed portion 282 having a first clamping surface 283 and a movable portion 284 having a second clamping surface 285. In an embodiment, the second clamping surface 285 may be substantially parallel the first clamping surface 283. In other embodiments, the second clamping surface 285 may be non-parallel the first clamping surface 283.

In the illustrated embodiment, the movable portion 284 can move toward and/or away from the fixed portion 282 via a pair of threaded members 286 extending between the movable portion 284 and the fixed portion 282. Because the distance between the fixed portion 282 and the movable portion 284 is adjustable, the anchoring system 208 can be selectively sized or adapted to fit onto walls or other structures of varying sizes and/or shapes. Accordingly, the system 200 may be customized as desired by the user to fit a variety of different structures (e.g., different makes of truck walls). While the movable portion 284 is described as moving by a pair of threaded members, in other embodiments, the movable portion 284 can move toward and/or away from the fixed portion 282 via one or more lever, cams, or the like. Further, while the anchoring system 208 is illustrated including a two threaded members, in other embodiments, the anchoring system 208 may include one, three, five, or any other suitable number of threaded members. Moreover, while the movable portion 284 is described as being movable toward and/or away from the fixed portion 282, in other embodiments, the fixed portion 282 may be movable toward and/or away from the movable portion 284. In yet other embodiments, the fixed portion 282 and the movable portion 284 may both be movable relative to one another.

Referring to FIG. 2C, the fixed portion 282 may comprise a J-like member 282*a* and a generally rectangular upper member 282*b*. The upper member 282*b* may include a pair of through-holes configured to receive the threaded members 286. In an embodiment, the upper member 282*b* may be a shell-like member. In other embodiments, the upper member 282*b* may be a solid member or a skeletal member. While the upper member 282*b* is shown being generally rectangular, in other embodiments, the upper member 282*b* may be generally L-shaped, T-shaped, generally cubical, or any other suitable shape. In an embodiment, the J-like member 282*a* may include the first clamping surface 283 of the anchoring system 208. The first clamping surface 283 can be configured to engage a front surface and/or a back surface of a wall.

Optionally, the J-like member 282*a* may further be configured to attach the anchoring system 208 to the lid 204 and/or the container 202. For example, the mounting member 205 may be positionable in the J-like member 282*a* to attach the anchoring system 208 to the container 202 and/or the lid 204. As illustrated in FIG. 2C, the mounting member 205 may exhibit geometric configuration that generally corresponds to an interior of the J-like member 282*a*. Such a configuration allows the mounting member 205 to be positioned in the J-like member 228*a* to attach the container 202 and/or the lid 204 to the anchoring system 208. In an embodiment, the mounting member 205 may be secured in the J-like member 282*a*. For example, the mounting member 205 may be secured to the J-like member of the fixed portion 282 via welding, an interference fit, adhesives, mechanical fasteners, or any other suitable technique. In other embodiments, the mounting member 205 may be releasably secured within the J-like member 282*a*. In other embodiments, a portion of the outer surface of the J-like member 282*a* may be attached to the back side wall 214 of the container 202.

The movable portion 284 may comprise a plate member including a lower portion 284*b* and an upper portion 284*b*. In an embodiment, the lower portion 284*a* may comprise a generally rectangular portion. The lower portion 284*a* may include the second clamping surface 285 of the anchoring system 208. Similar to the second clamping surface, the second clamping surface 285 can be configured to engage a front or back surface of a wall.

The upper portion 284*b* may exhibit an L-like profile with a lower section and an upper section. As shown, the lower portion 284*a* may be attached to the upper portion 284*b* such that the lower section of the upper portion 282*b* offsets the upper section of the upper portion 284*b* from the lower portion 284*a*. The lower section of the upper portion 284*b* may be configured to rest on an upper surface of a wall. For example, the lower section of the upper portion 284*b* may form a stop that is configured to engage an upper surface of a wall. Such a configuration may help stabilize and/or limit movement of the system 200. In the illustrated embodiment, the upper section of upper portion 284*b* may include two through-hole configured to receive the threaded members 286.

The threaded members 286 may be extended through the through-holes of upper portion 284*b* of the movable portion 284 and the upper portion 282*b* of the fixed portion 282. In an embodiment, an annular member 292 including a threaded through-hole (e.g., a nut-type member) may be threaded onto the threaded member 286. The annular member 292 may be configured to help move the annular member 292. For example, when the threaded member 286 is rotated relative to the annular member 292 in a first direction, the annular member 292 may move along the threads of the threaded member 186 to move the movable portion 284 toward the fixed portion 282. When the threaded member 286 is rotated relative to the annular member 292 in a second direction, the annular member 292 may disengage from the movable portion 284 such that the movable portion 284 may be moved away from the fixed portion 282. Accordingly, a user can adjust and/or control the distance between the movable portion 284 and the fixed portion 282 by rotating the threaded member 286 relative to the annular member 292. By controlling the distance between the movable portion 284 and the fixed portion 282, a user can anchor the system 200 on a wall without forming any permanent holes in the hole. Moreover, the user can adjust the anchoring system 208 to fit walls of varying sizes and/or configurations. Optionally, the anchoring system 208 may include lock washers 287 configured to limit inadvertent rotation of the annular members 292 and threaded members 286.

While the threaded member 286 is described in combination with the annular member 292. In other embodiments, the annular member 292 may be omitted. For example, in an embodiment the through-hole of the upper portion 282*b* of the fixed portion 282 and/or the through-hole of upper portion 284*b* of the movable portion 282 may be threaded and configured to threadedly engage the threaded member 286.

In an embodiment, the threaded member 286 can help maintain the first and second clamping surfaces 283, 285 generally parallel relative to one another. For example, the threaded member 286 may be a substantially rigid connection between the movable portion 284 and the fixed portion 282. Such a configuration can help limit rotation of the movable portion 284 and/or the fixed portion 282. Thus, the first and second clamping surfaces 283, 285 may remain substantially parallel.

In operation, a user may position the movable portion 284 and the fixed portion 282 of the anchoring system 208 over the wall 203. The wall 203 may be a back wall of a truck bed adjacent a wall of the truck cab 207. In other embodiments, the wall 203 may be a tailgate, a side wall, a boat wall, a retaining wall, a divider, or any other suitable type of wall.

The J-like portion 282*a* of the fixed portion 282 may be positioned on the wall 203 such that the first clamping surface 283 of the J-like portion 282*a* engages the front surface 203*c* of the wall 203. Optionally, the upper portion 282*b* of the fixed portion 282 may also be positioned on the upper surface 203*a* of the wall 203 such that the upper portion 282*b* substantially prevents downward movement of the system 200 relative to the wall 203. The threaded member 286 may then be rotated in a first direction relative to the annular member 292 to move the movable portion 284 toward the back surface 203*b* of the wall 203. The movable portion 284 can be moved until the second clamping surface 285 engages the back surface 203*b* of the wall 203. In an embodiment, the user may then continue to rotate the threaded member 286 in the first direction until the wall 203 is tightly clamped between the first clamping surface 283 and the second clamping surface 285. As shown, as the movable portion 284 engages the wall 203, the lower section of upper portion 284*b* is positioned on the upper surface 203*a* of the wall 203. Such a configuration may help stabilize the system 200 on the wall 203.

In addition, because the first and second clamping surfaces 283, 285 of the anchoring system 208 are substantially parallel, the clamping forces exerted on the wall 203 by the movable portion 284 and the fixed portion 282 are generally parallel such that the clamping forces of the anchoring system 208 do not tend to push the anchoring system 208 upward off of the wall 203.

Thus, the system 200 can be safely and quickly anchored on the wall 203 without the need of making permanent holes in the wall 203. Moreover, because of the adjustability of the anchoring system 208, the system 200 may be anchored to walls of varying sizes and configurations. Similar to the system 100, the system 200 may include one or more features configured to protect the wall 203 from surface damage.

Figure 3A:
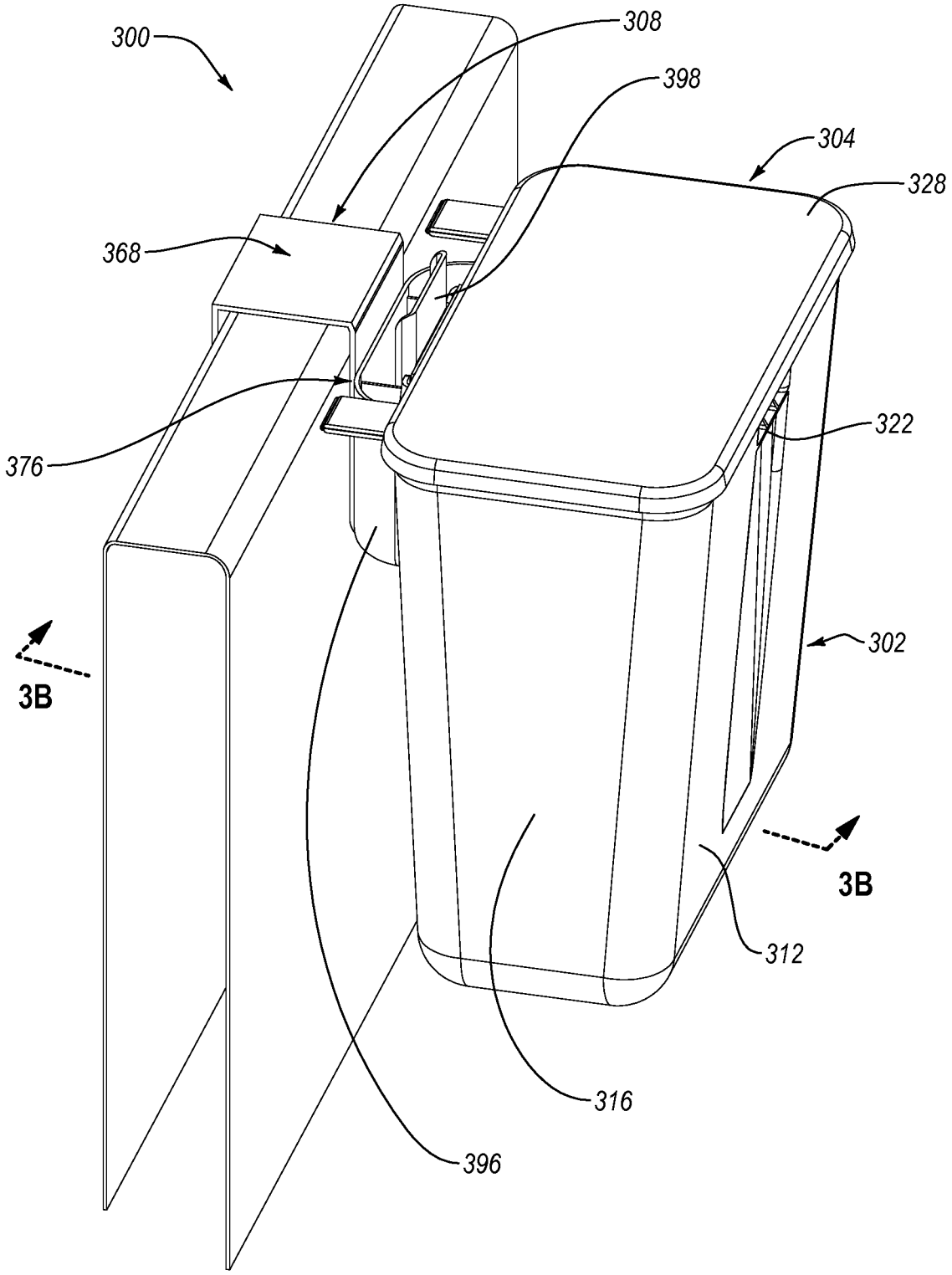
FIG. 3A is an isometric view of a wind-resistant container system according to another embodiment.
Figure 3B:
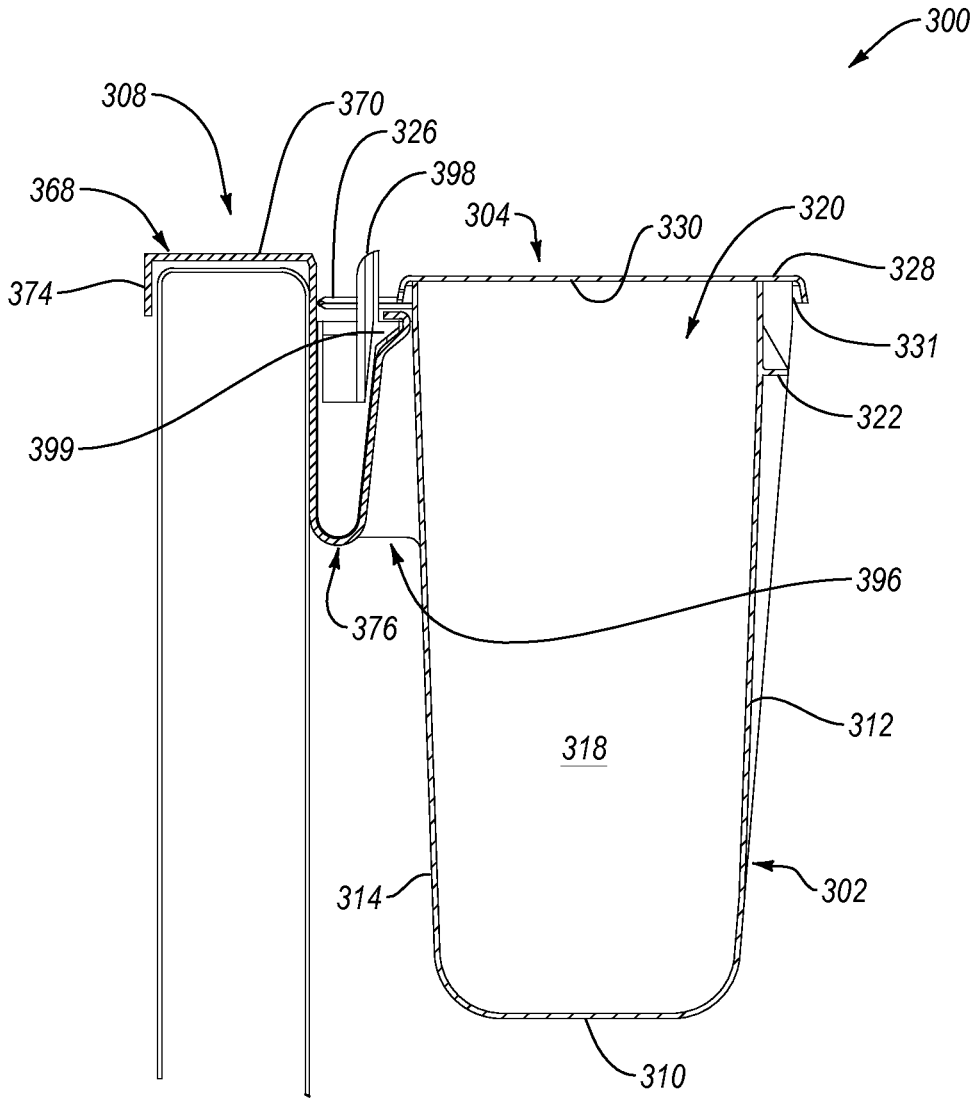
FIG. 3B is a cross-sectional view of the wind-resistant container system shown in FIG. 3A taken along line 3B-3B.
Figure 3C:
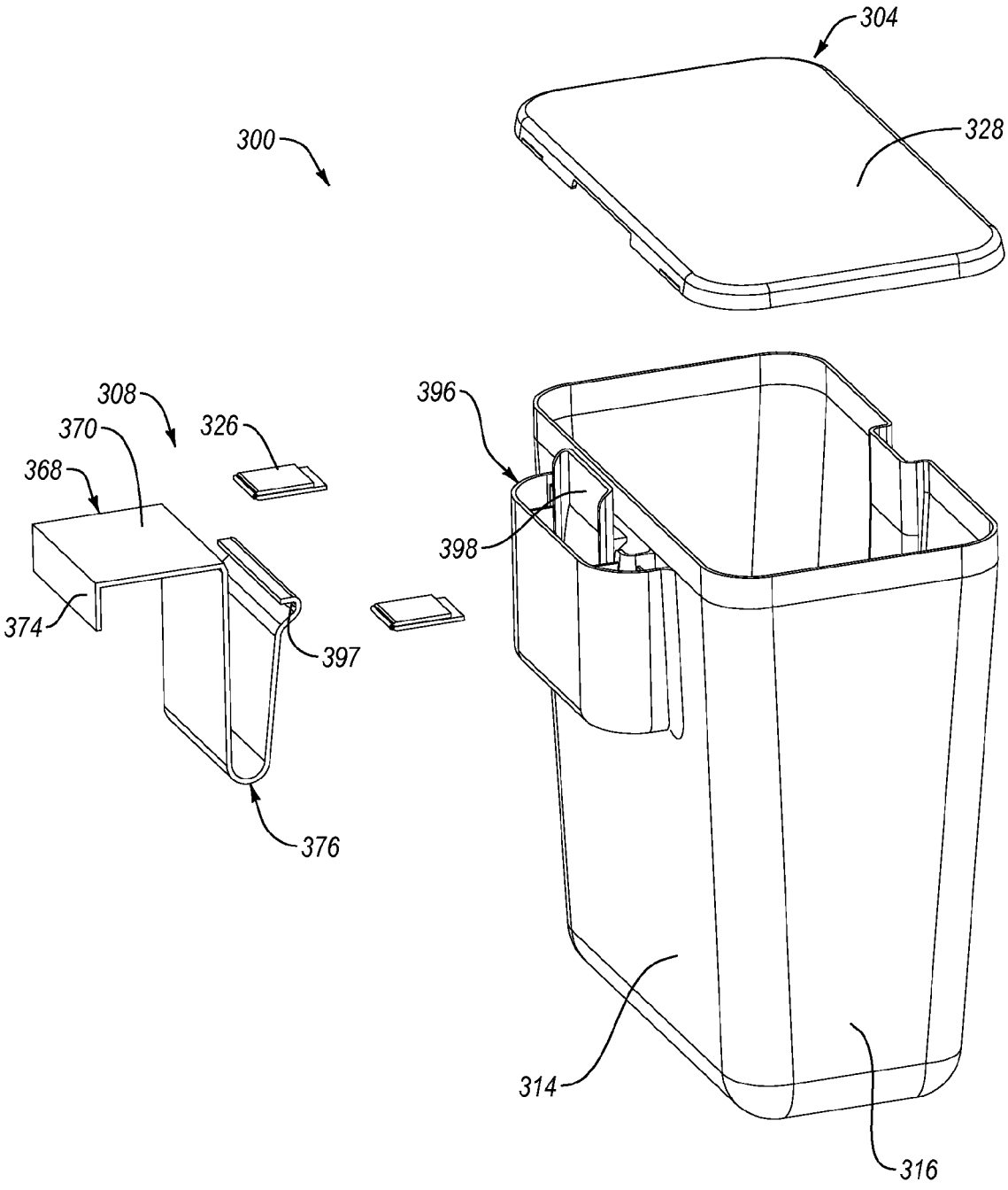
FIG. 3C is an exploded view of the wind-resistant container system shown in FIG. 3B.

FIGS. 3A through 3C illustrate a wind-resistant container system 300 according to another embodiment. The system 300 includes many of the same components as the systems 100 and 200 shown in FIGS. 1A through 2C. Therefore, in the interest of brevity, components of the system 300 that are identical or similar to each other have been provided with the same reference numerals, and an explanation of their structure and function will not be repeated unless the components function differently in the systems 100 and 200. However, it should be noted that the principles of the system 300 can be employed with any of the embodiments described with respect to FIGS. 1A through 2C.

The wind-resistant container system 300 can include a container 302, a lid 304, and an anchoring system 308. Similar to the container 102, the container 302 can exhibit any suitable configuration and may be formed of any suitable material. For example, the container 302 may include a bottom 310 (shown in FIG. 3B), front and back longitudinal side walls 312, 314, and a pair of opposite end walls 316. Together, the bottom 310, front and back side walls 312, 314 and end walls 316 may define a receiving space 318 with upper edges of the front and back side walls 312, 314, and end walls 316 defining an opening 320 into the receiving space 318. In an embodiment, the container 302 may include a handle 322. For example, the front side wall 312 may include a recessed portion having a shoulder portion near the upper edge that forms the handle 322. The handle 322 may allow a user to more easily maneuver the container 302.

The system 300 may further include a lid 304 configured to selectively cover the opening 320 of the container 302. The lid 304 may include an upper surface 328 and a lower surface 330. The lid 304 may be movable relative to the opening 320. In an embodiment, one or more flap members 326 may connect the lid 304 to the back side wall 314 of the container 302. The one or more flap members 326 may form a hinged connection between the lid 304 and the container 302. The lid 304 may be pivotable between a closed position, wherein the lid 304 covers the opening 320, and an open position, wherein the lid 304 is rotated away from the opening 320.

Optionally, the lid 304 may include one or more features to help secure the lid in the closed position. For example, the, the lower surface 330 of the lid 304 may include a lip portion 331 that is configured to overlap at least a portion of the front and back side walls 312, 314 and/or the end walls 316 of the container 302. Accordingly, the portion of the front and back side walls 312, 314 and/or the end walls 316 of the container 302 extending above the lip portion 331 of the lid 304 may help provide an additional barrier against any wind that may attempt to pass between the lid 304 and the upper edge of the support system 306. In an embodiment, the outer diameter of the upper edge of the container 302 may be slightly larger than the inner diameter of the lip portion 331 such that when the lid 304 is closed an interference fit is created between the lid 304 and the container 302. While the lid 304 is illustrated being pivotally connected to the back side wall 314 of the container 302, in other embodiments the lid 304 may be pivotally connected the container 302 along the front side wall 312 or one of the end walls 316. Moreover, while the lid 304 is shown being pivotally connected to the container 302, in other embodiments, the lid 304 may be removably attached to the container 302 or removably and/or pivotally attached to the container 302. For example, in an embodiment, the lid 304 may be threadedly attached to the container 302. In other embodiments, the lid 304 may be attached to the container 302 via a press fit connection, stitching, magnets, adhesives, pin connections, or the like. In other embodiments, the lid 304 may be integrally formed on the container 302.

Like the anchoring systems 108 and 208, the anchoring system 308 may exhibit any suitable configuration. For example, the anchoring system 308 may comprise an over-the-wall hook configured to anchor the system 300 on a wall. Referring now to FIGS. 3B and 3C, the anchoring system 308 may comprise a bracket 368 including a top portion 370, a back portion 374 attached to the top portion 370, and a J-hook 376 attached to the top portion 370 opposite the back portion 374.

In an embodiment, the anchoring system 308 may be configured to be hooked over a wall. For example, a back surface of the J-hook 376 may be positioned on the front surface of a wall. The back portion 374 may be positioned on the back surface of the wall and the top portion 370 may be positioned on the upper surface of the wall. In an embodiment, the J-hook 376 and/or the back portion 374 may be resiliently biased toward the other portion. Such a configuration may allow the anchoring system 308 to hook itself onto a wall or other structure. Accordingly, the anchoring system 308 may securely hook or anchor the system 300 to a tailgate, a sidewall, a front wall, or other suitable structure. Thus, the anchoring system 308 can anchor the system 300 on a wall without the need of making permanent modifications to the wall. Moreover, the J-hook 376 and/or the back portion 374 may be flexible such that the anchoring system 308 fits walls of varying sizes. The J-hook 376 and/or the back portion 374 may be generally planar. In other embodiments, J-hook 376 and/or the back portion 374. In an embodiment, the bracket 368 may be integrally formed of a singular resilient plastic and/or metal member. In other embodiments, the bracket 368 may be formed of any suitable material and/or number of members connected to one another via mechanical fasteners, welds, adhesives, or the like. In other embodiments, the bracket 368 may include one or more gripping features configured to help the bracket 368 grip the surface of the wall or structure. For example, the back surface of the J-hook 376 may include one or more rubber ridges configured to help the anchoring system 308 grip a wall or structure.

The anchoring system 308 may be attached to the container 302 in any suitable manner. For example, in an embodiment, the back side wall 314 may include a receiving portion 396 that comprises a semi-stadium-like shell structure. The receiving portion 396 may be integrally formed on the back side wall 314 of the container 302. In other embodiments, the receiving portion 396 may be attached to the back side wall 314. For example, the receiving portion 396 may be configured to be attached to a variety of conventional containers.

While the receiving portion 396 is illustrated comprising a semi-stadium-like shell structure, it will be appreciated that the receiving portion 396 may exhibit any suitable configuration. For example, the receiving portion 396 may comprise a semi-elliptical structure, a trapezoidal-like structure, a semi-rectangular-like structure, a substantially solid structure, a skeletal structure, or any other suitable structure.

The receiving portion 396 may include a lever portion 398. In an embodiment, the lever portion 398 may include a latch portion 399 configured to selectively lock the J-hook 376 within the receiving portion 396 of the container 302. In an embodiment, the lever portion 398 can resiliently bias the latch portion 399 to protrude into a locking space 397 (shown in FIG. 3C) formed in the J-hook 376. Such a configuration can selectively lock the J-hook 376 of the anchoring system 308 within the receiving portion 396 of the container 302. To unlock the J-hook 376 from the receiving portion 396, the lever portion 398 can be moved to a release position, wherein the latch portion 399 is removed from the locking space 397 by the lever portion 398. The latch portion 399 may exhibit any geometric configuration. For example, the latch portion 399 may exhibit a generally triangular cross-sectional shape, a generally semi-elliptical cross-sectional shape, a generally curved shape, an angular shape, a w-like shape, an S-like shape, a v-like shape, a generally u-like shape, combinations thereof, or any other suitable shape. In an embodiment, the locking space 397 may be configured to generally correspond to the shape of the latch portion 399. In other embodiments, the locking space 397 may be configured to not correspond to the shape of the latch portion. For example, the latch portion 399 may be generally triangular and the locking space 397 may be generally cubical.

In operation, the J-hook 376 of the anchoring system 308 can be positioned in the receiving portion 396 of the container 302. More particularly, the lever portion 398 of the receiving portion 396 may be located within the J-hook 376 such that the latch portion 399 protrudes in the locking space 397 of the J-hook 376. As noted above, the lever portion 398 can be configured to bias the latch portion 399 into the locking space 397 of the J-hook 376. Optionally, the angle of the latch portion 399 may help guide the latch portion 399 into the locking space 397. With the latch portion 399 protruding in the locking space 397 of the J-hook 376, the anchoring system 308 can be considered secured to the container 302.

To remove the anchoring system 308 from the container 302, a user can move the lever portion 398 to the release position such that the latch portion 399 is withdrawn from the locking space 397 of the J-hook 376. With the lever portion 398 in the release position, the J-hook 376 can be removed from the receiving portion 396 and the anchoring system 308 can be detached from the container 302. Accordingly, the anchoring system 308 can be quickly and securely connected and disconnected from the container 302.

While the J-hook 376 is illustrated including the locking space 397 and the lever portion 398 is illustrated including the latch portion 399, in other embodiments, the J-hook 376 may include the latch portion 399 and the lever portion 398 may include the locking space 397. Moreover, while the J-hook 376 is described, in other embodiments, the anchoring system 308 may include a L-hook, a U-hook, or any other suitable structure.

FIGS. 4A through 4G illustrate a wind-resistant container system 400 according to another embodiment. The system 400 includes many of the same components as the systems 100, 200, and 300 shown in FIGS. 1A through 3C. Therefore, in the interest of brevity, components of the system 400 that are identical or similar to each other have been provided with the same reference numerals, and an explanation of their structure and function will not be repeated unless the components function differently in the systems 100, 200, 300, and 400. However, it should be noted that the principles of the system 400 can be employed with any of the embodiments described with respect to FIGS. 1A through 3C.

The system 400 may include a support system 406, a container 402, a lid 404, and an anchoring system 408. In an embodiment, the support system 406 may comprise an exterior casing. For example, in the illustrated embodiment, the support system 406 may include a generally round rectangular bottom 456 (shown in FIG. 4D), front and back longitudinal side walls 458, 460, and a pair of opposite end walls 462. The front and back side walls 458, 460 may be connected to the bottom 456 and may extend generally upward therefrom. The end walls 462 may also be connected to the bottom 456 and may extend between the front and back side walls 458, 460. Together, the bottom 456, front and back side walls 458, 460, and end walls 462 may define an interior space 464 (shown in FIG. 4B) with upper edges of the front and back side walls 458, 460, and end walls 462 defining a top opening into the interior space 464. In the illustrated embodiment, the back side wall 460 may have a height greater than a height of the front side wall 458 such that the upper edges of the end walls 462 slope downward from the back side wall 460 toward the front side wall 458.

While the support system 406 is illustrated exhibiting a generally rounded rectangular configuration, in other embodiments, the support system 406 may exhibit a generally cylindrical configuration, a generally cubical configuration, a generally irregular geometric configuration, or any other suitable shape. Moreover, while the height of the back side wall 460 is illustrated being greater than the height of the front side wall 458, in other embodiments, at least a portion of the height of the front side wall 458 may be greater than the height of the back side wall 460 or the front and back side walls 458, 460 may have substantially equal heights. In addition, while the bottom 456 is described being generally planar, in other embodiments, the bottom 456 may include one or more curved portions, one or more non-planar portions, planar and curved portions, combinations thereof, or any other suitable configuration. In some embodiments, the support system 406 may include one or more pockets (not shown). For example, the end walls 462, the front side wall 458, and/or the back side wall 460 may include one or more pockets configured to store items such as tools, keys, gloves, and the like on the support system 406. In other embodiments, the pockets may be omitted.

The support system 406 may be formed of any suitable material. For example, the support system 406 may include military grade textiles and/or plastic materials. In other embodiments, the support system 406 may include metals, woven fabrics, cloth, bamboo, wood, rubber, canvas, composites, vinyl, combinations thereof, or any other suitable materials. Optionally, the support system 406 may include one or more compliant or noncompliant plastic layers located within a canvas envelope. In yet other embodiments, the support system 406 may include a metal or plastic frame within a plastic, rubber, or fabric body. In further embodiments, the support system 406 may be treated. For example, the support system 406 may include one or more coats of waterproofing materials, stain resistant materials, deodorizing materials, combinations thereof, or any other suitable material. Moreover, the support system 406 may include any suitable number of layers.

Figure 4A:
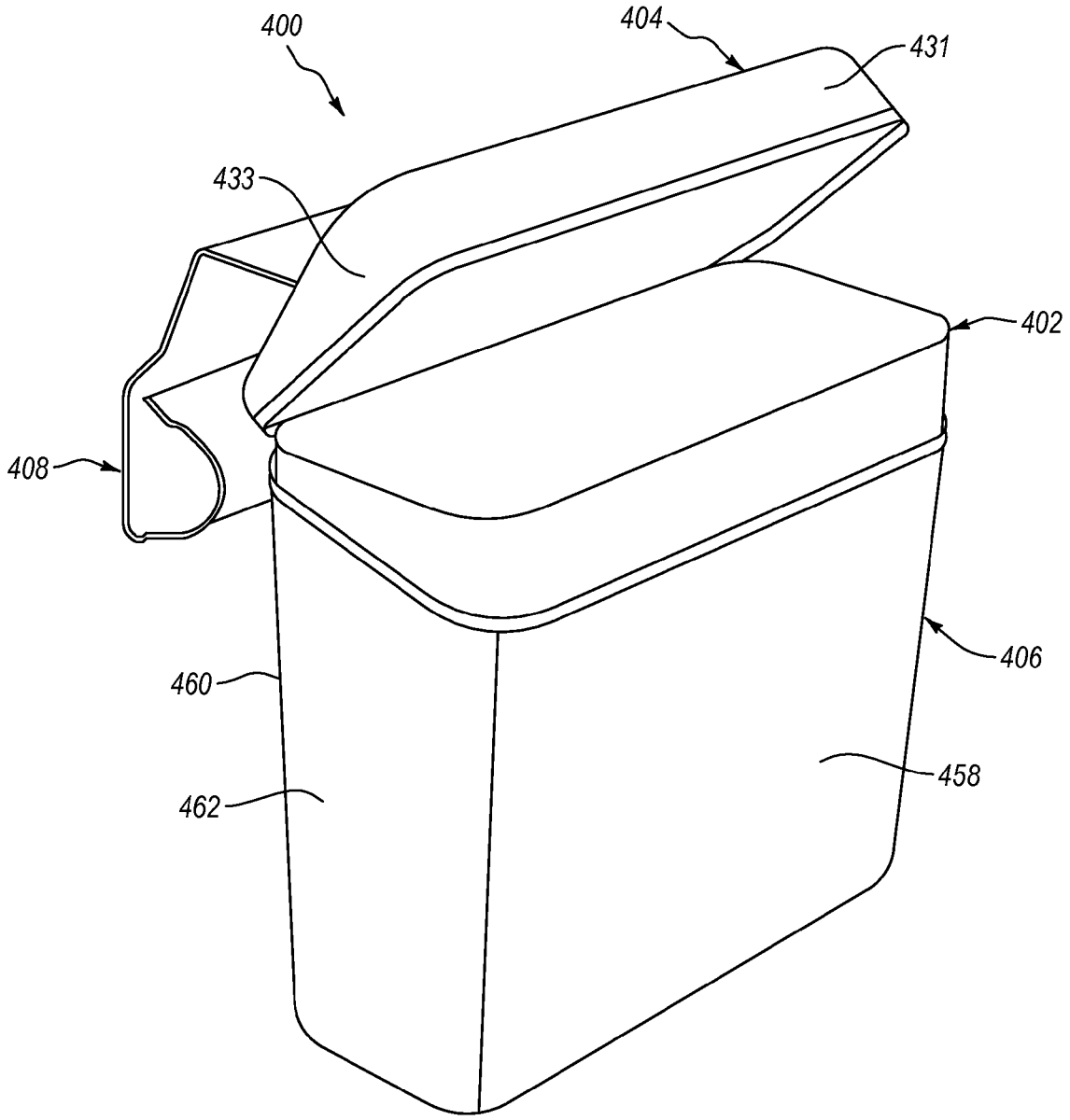
FIG. 4A is a front isometric view of a wind-resistant container system according to an embodiment.
Figure 4B:
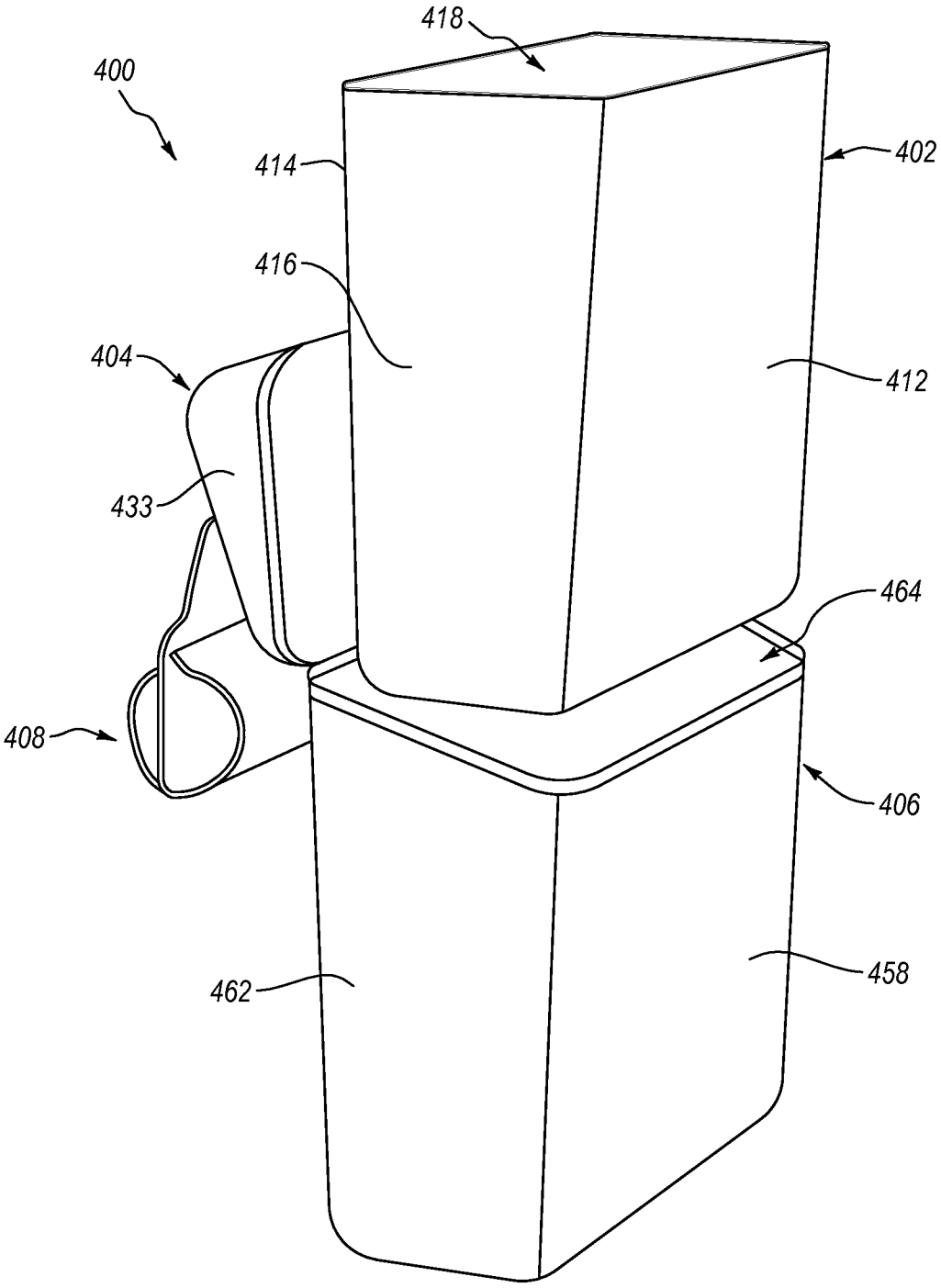
FIG. 4B is an exploded view of the system shown in FIG. 4A.

Referring now to FIG. 4B, the container 402 may be sized and configured to be removably positioned within the interior space 464 of the support system 406. In an embodiment, the container 402 may comprise a liner including a bottom 410 (shown in FIG. 4D), front and back side walls 412, 414 connected to the bottom 410 and extending generally upward therefrom, and a pair of opposite end walls 416 extending between the front and back side walls 412, 414 that generally correspond to the interior space 464 of the support system 406. Together, the bottom 410, front and back side walls 412, 414, and end walls 416 may define a receiving space 418 with upper edges of the front and back side walls 412, 414, and end walls 416 defining a top opening into the receiving space 418. The receiving space 418 may be configured to receive and temporarily store trash, garbage, and/or other materials. In an embodiment, when the receiving space 418 of the container is relatively full, a user may conveniently remove the container 402 from the support system 406 to be emptied. Once emptied, the user may then reposition the container 402 within the interior space 464 of the support system 406. Such a configuration allows the system 400 to remain secured in a relatively fixed position even during trash or garbage disposal.

In the illustrated embodiment, the back side wall 414 may have a height generally equal to a height of the front side wall 412 such that the upper edges of the front and back side walls 412, 414, and end walls 416 are generally coplanar. Accordingly, at least a portion of the container 402 may extend above the upper edges of the front side wall 412 and the end walls 416 of the support system 406 as shown in FIG. 4A. As discussed in more detail below, such a configuration may help prevent wind or water from accessing the receiving space of the container 402 such that garbage or items within may stay in place within the interior space 464.

While the container 402 is described as generally corresponding to the interior space 464 of the support system 406 in other embodiments, the container 402 may be configured different than the interior space 464 of the support system 406. For example, the container 402 may exhibit a generally cylindrical or elliptical configuration and the interior space 464 of the support system 406 may exhibit generally rectangular shell-like configuration. Moreover, while the container 104 is described as a substantially rigid plastic container, in other embodiments, the container 402 may be formed of one or more metals, fabrics, rubber, textiles, composites, thermoplastics, combinations thereof, or the like. Moreover in other embodiments, the container 402 may be substantially flexible rather than substantially rigid. For example, in an embodiment, the container 402 may include one or more flexible materials such as rubber or flexible plastic such that the container 402 may at least partially conform to the shape of the interior space 464 of the support system 406 and/or the contents of the container 402 may generally shape at least a portion of the container 402. In yet other embodiments, the container 402 may be omitted. For example, trash, garbage, and/or other materials such as groceries, fishing tackle, tools, keys, gloves, and the like in the interior space 464 of the support system 406. It will be appreciated that the container 402 may be formed in any suitable manner.

Similar to the system 100, the system 400 includes a lid 404. The lid 404 can be configured to selectively cover the top opening of the support system 406 and/or the container 402. For example, in the illustrated embodiment, the lid 404 may be attached to the upper edge of the back side wall 414 along a substantial length of the back side wall 414 to form a hinge between the lid 404 and the support system 406. The hinge may allow the lid 404 to be pivoted between a closed position (shown in FIG. 4C) and an open position (shown in FIG. 4A). The lid 404 may include a top cover portion 428, a back side portion 429 (shown in FIG. 4E), a front side portion 431, and end side portions 433. The top cover portion 428 may be configured to generally cover the top opening of the support system 406 and/or the container 402 when the lid is closed. The back side portion 429 and the front side portion 431 may be connected to the top cover portion 428 and may extend generally downward therefrom. In an embodiment, the back side portion 429 may be pivotally attached to the back side wall 414. The end side portions 433 may also be connected to the top cover portion 428 and may extend between the front and back side portions 431, 429.

Figure 4C:
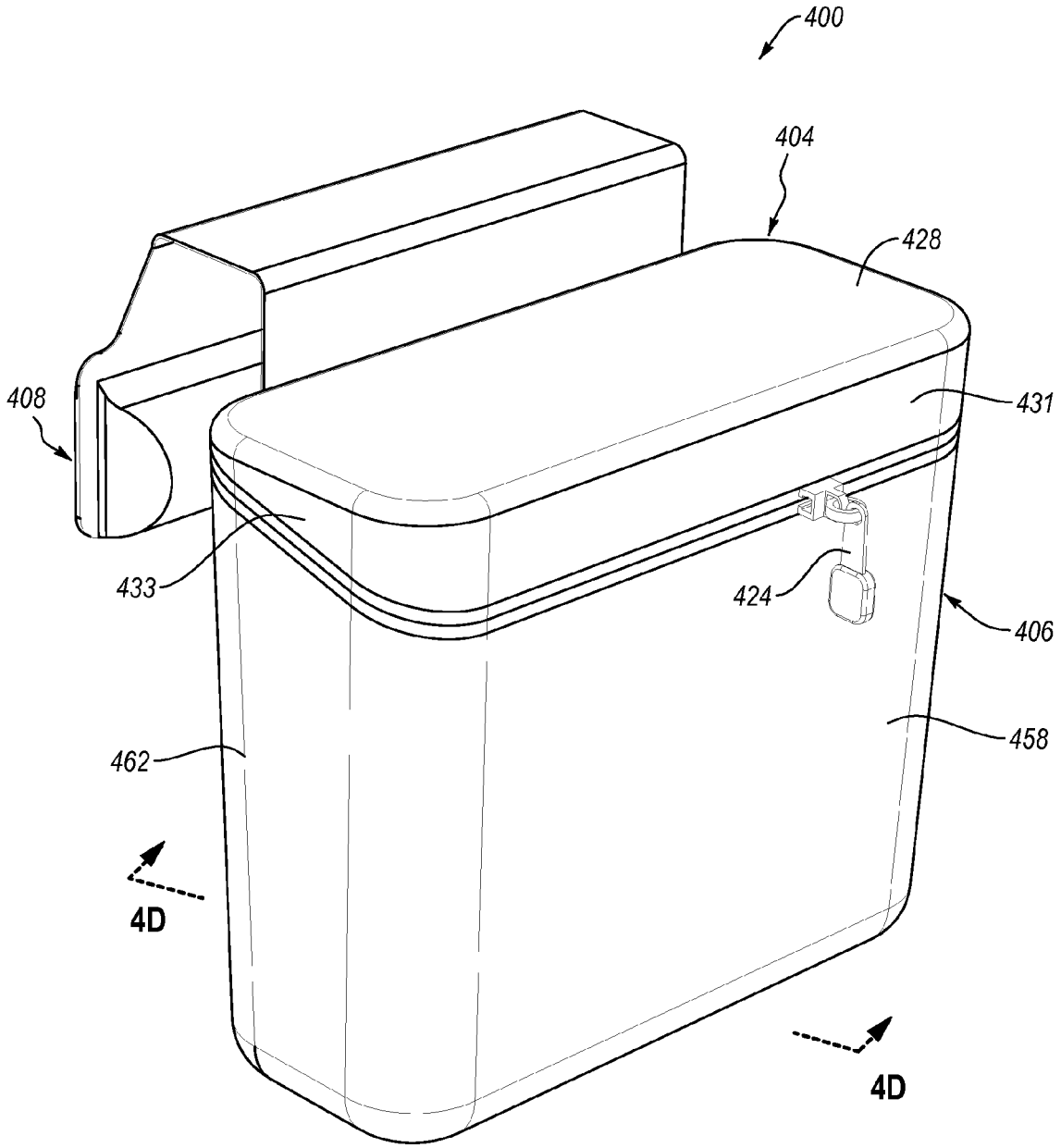
FIG. 4C is a front isometric view of the system shown in FIG. 4A in a closed configuration.

In the open position, at least a portion of the top cover portion 428 may be rotated away from the upper edge of the support system 406 about the hinge such that the top opening of the support system 406 and/or the container 402 may be accessible to a user, thereby, allowing a user to access the receiving space 418 of the container 402 to add and/or remove trash, garbage or other materials from the receiving space 418. In the closed position, the top cover portion 428 may be rotated toward the upper edge of the support system 406 about the hinge such that the top cover portion covers at least the top opening of the support system 406 and/or the container 402. As shown in FIG. 4C, in the closed position, at least a portion of the front side portion 431, back side portion 429, and end side portions 433 may also overlap a portion the front side wall 412 and end walls 416 of the container 402 extending above the support system 406. Accordingly the portion of the front side wall 412 and end walls 416 of the container 402 extending above the support system 406 may provide an additional barrier against any wind or water that may attempt to pass between the lid 404 and the upper edge of the support system 406. Such an overlapping configuration may help prevent any wind, water, or the like from entering the receiving space 418 of the container 402.

While the lid 404 is illustrated being pivotally connected to the back side wall 460 of the support system 406, in other embodiments the lid 404 may be pivotally connected the support system 406 along the front side wall 458 or one of the end walls 462. Moreover, while the lid 404 is shown being pivotally connected to the support system 406, in other embodiments, the lid 404 may be removably attached to the support system 406 or removably and/or pivotally attached to the container 402. For example, in an embodiment, the lid 404 may be threadedly attached to the support system 406. In other embodiments, the lid 404 may be attached to the support system 406 via a press-fit connection, stitching, magnets, adhesives, pin connections, or the like. In other embodiments, the lid 404 may be integrally formed on the support system 406 or container 402.

The lid 404 may be formed of any suitable materials. For example, the lid 404 may be formed of the same or similar materials as the support system 406. In other embodiments, the lid 404 and the support system 406 may be formed of different materials. For example, in an embodiment, the lid 404 may be configured as a hard plastic lid attached to a textile support system 406. Optionally, the lower surface of the lid 404 that faces the interior space 464 when the lid 404 is in the closed position may be made waterproof by, for example, lining the inner-facing surfaces with a waterproof fabric, or by treating the lid material or materials in such a manner as to render it waterproof, or water resistant.

Referring still to FIG. 4C, the system 400 may include one or more closure elements configured to selectively secure the lid 404 in the closed position. For example, in the illustrated embodiment, the system 400 may include a closure element comprising a two-way zipper 424 that extends around the unhinged periphery of the of the upper edge of the support system 406 around the end walls 462 and the front side wall 458, and along the complementary portions of the lid 404 that face these wall sections when the lid 404 is in the closed position. Zipper 424 allows lid 404 to be secured to walls of the support system 406 by closing the zipper 424. Such a configuration may help prevent animals, children, wind, and/or other elements from accessing the receiving space 418 of container 402 when the lid 404 is in the closed position. With the zipper 424 unzipped and with the lid 404 in the open position, the interior space 464 of the support system 406 and/or the receiving space 418 of the container 402 may be exposed and/or accessed by a user. In an embodiment, the zipper 424 may be waterproof or water resistant.

While the closure element is shown as zipper 424, other closure elements are possible such as adhesives, magnets, buttons, snaps, Velcro® (a hook and loop type closure system), clasps, latch systems, combinations thereof, or any other suitable closure element. Furthermore, while the zipper 424 is shown extending along the upper edge of the support system 406, in other embodiments, the zipper 424 may extend along a side surface of the support system 406. Moreover, in other embodiments, the zipper 424 may extend only a portion of the unhinged periphery of the upper edge of the support system 406 or further around the upper edge of the back side wall 460 of the support system 406 such that the lid 404 may be removable from the system 400. Such a configuration may help prevent wind, water, children, or the like from accessing the system 400. In other embodiments, the one or more closure elements may be omitted.

Figure 4D:
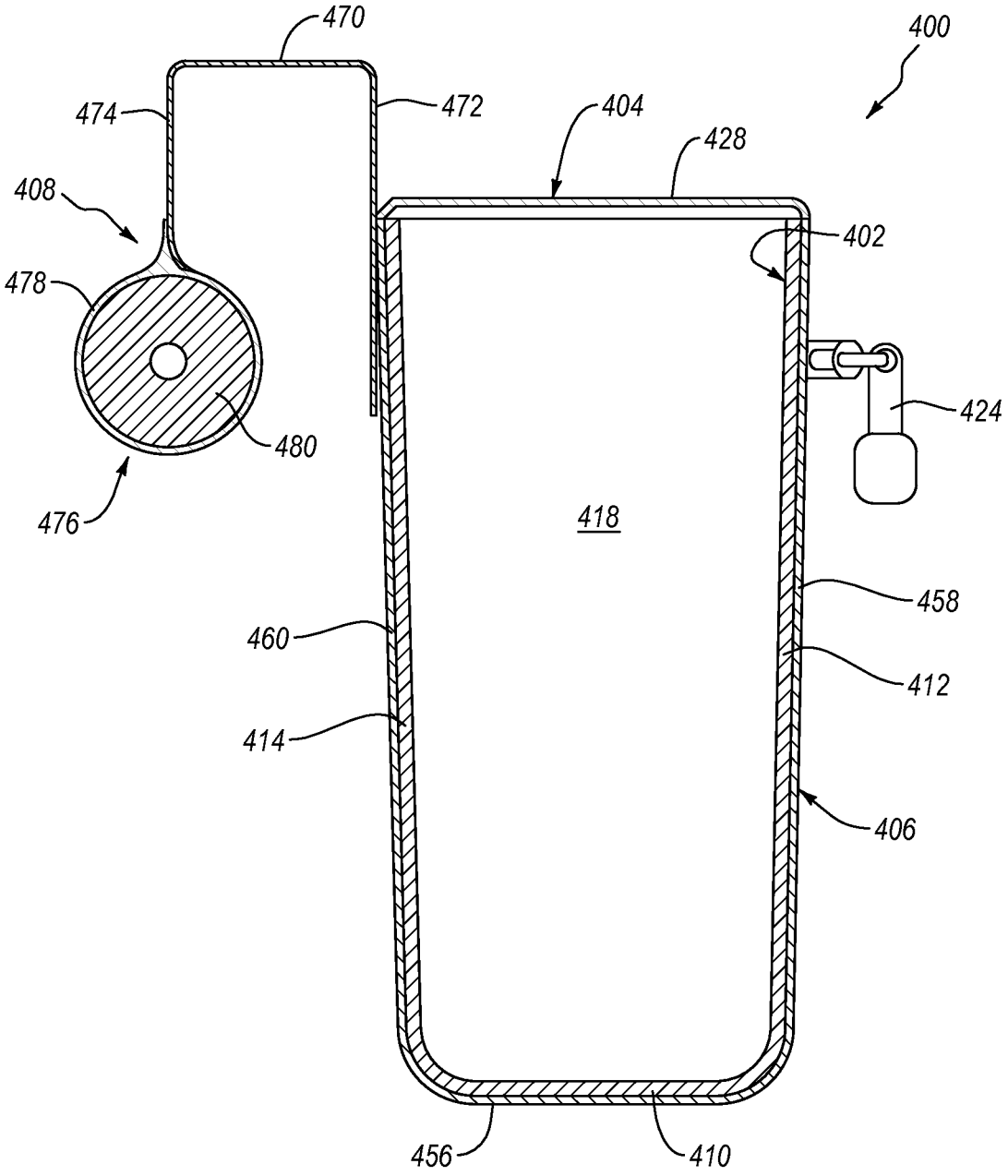
FIG. 4D is a cross-sectional view of the system shown in FIG. 4A.
Figure 4E:
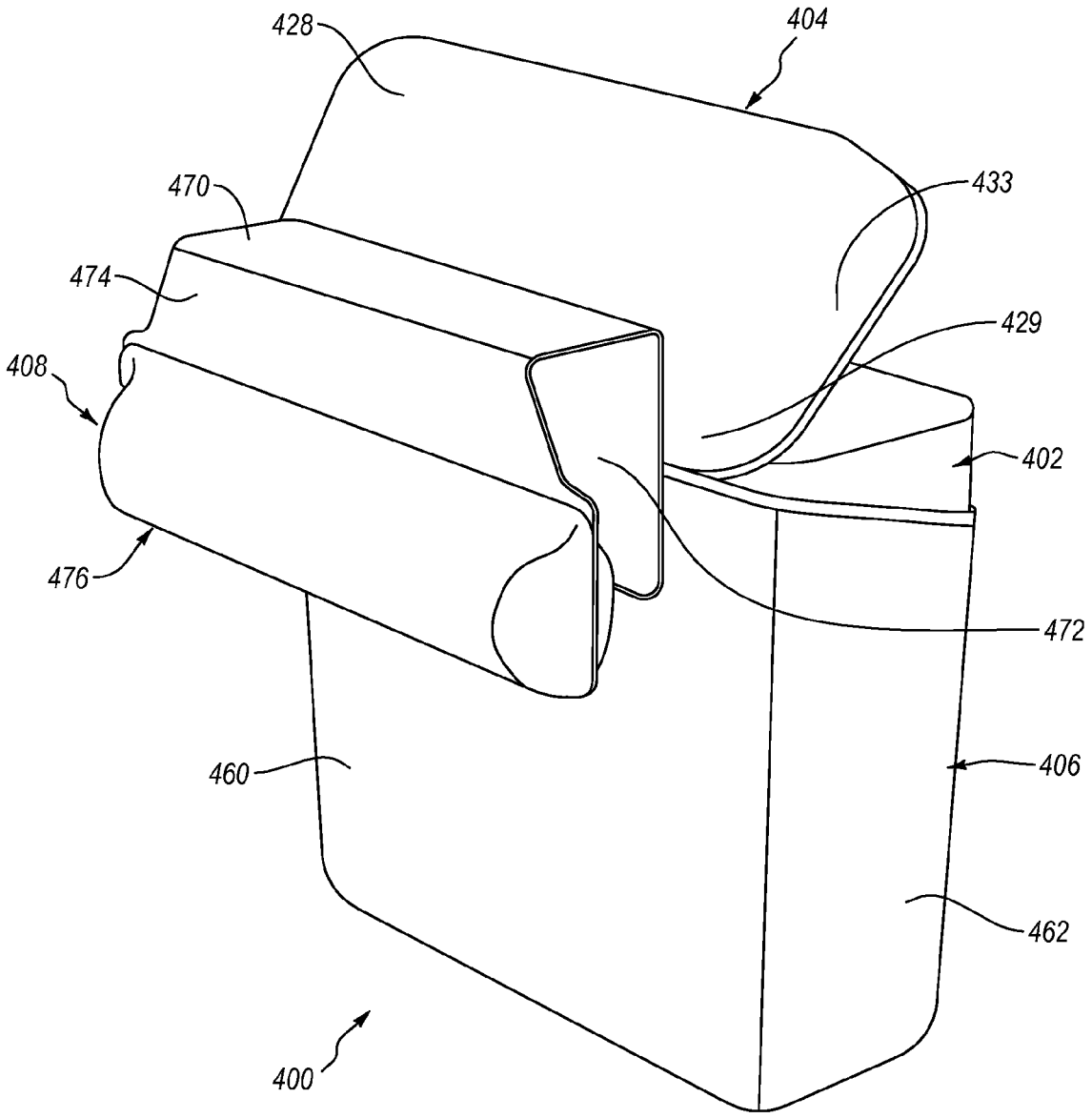
FIG. 4E is a back isometric view of the system shown in FIG. 4A.
Figure 4F:
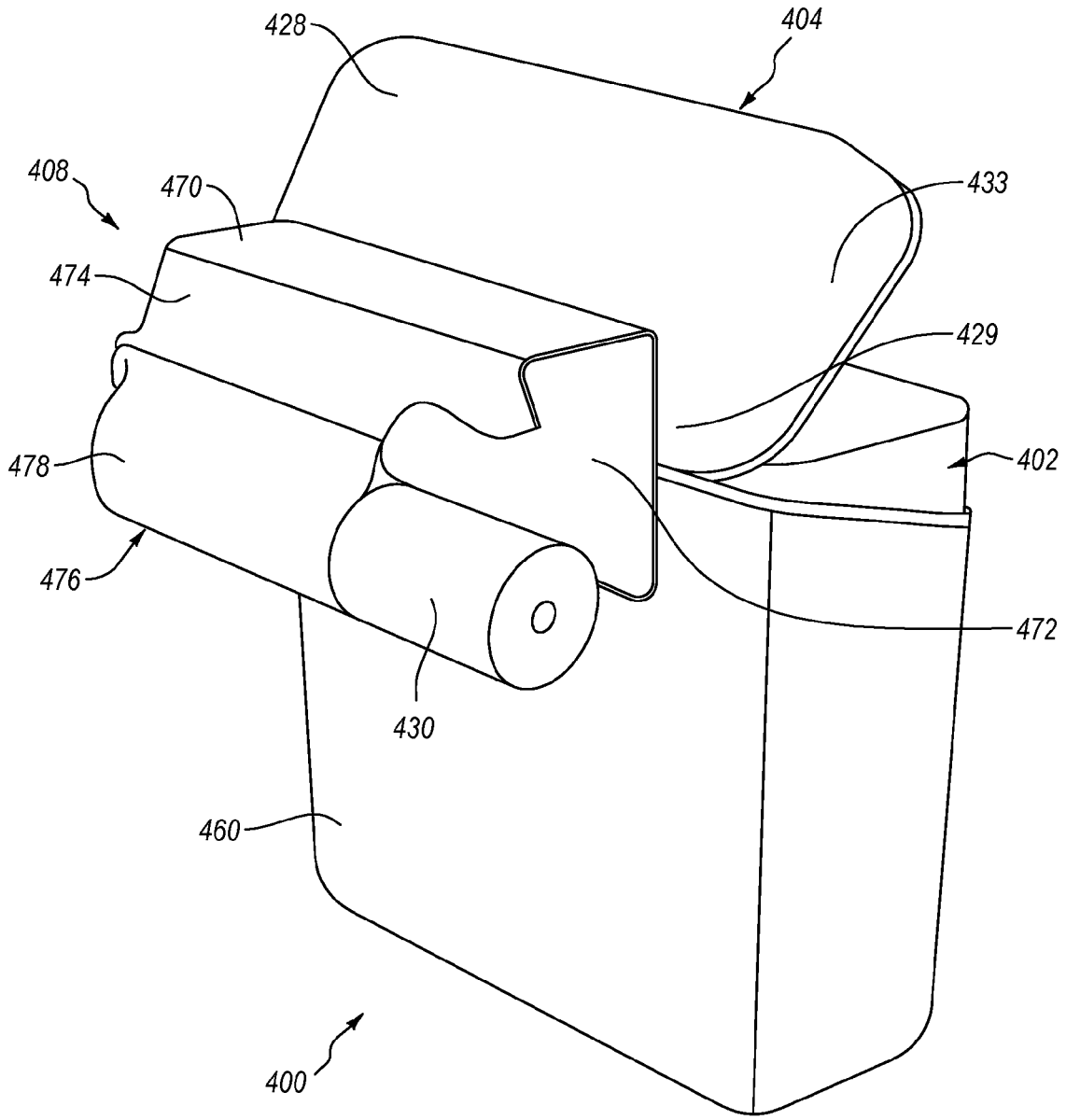
FIG. 4F is a partial back isometric view of the system shown in FIG. 4A.

Referring now to FIGS. 4D through 4F, the anchoring system 408 may exhibit any suitable configuration and may be configured to help anchor the system 400 to one or more surfaces, walls, and/or structures. For example, in the illustrated embodiment, the anchoring system 408 may comprise a generally U-shaped member and an anchor portion 476. The generally U-shaped member may comprise a top portion 470, a front portion 472, and a back portion 474. The front and back portion 472, 474 may both extend generally downward from opposite ends of the top portion 470. As shown, the front portion 472 may be connected to an upper portion of the back side wall 460 of the support system 406 and the back portion 474 may be generally parallel and/or non-parallel to the front portion 472. In an embodiment, a lower portion of the back portion 474 may be resiliently biased toward the front portion 472 such that the generally U-shaped member of the anchoring system 408 may accommodate walls or structures of various thicknesses. Moreover, the resiliently biased back portion 474 may be configured such that the generally U-shaped member may clamp or anchor the anchoring system 408 on a wall or structure. In other embodiments, the back portion 474 may not be resiliently biased toward the front portion 472.

The front and/or back portions 472, 474 may be generally planar. In other embodiments, the front and/or back portions 472, 474 may include at least one curved portion. For example, in an embodiment, the front portion 472 may include a convexly-curved portion configured to engage a surface of a wall or structure. In an embodiment, the generally U-shaped member may be integrally formed of a singular resilient plastic and/or metal member. In other embodiments, the generally U-shaped member may be formed of any suitable material and/or number of members connected to one another via mechanical fasteners, welds, adhesives, or the like. In other embodiments, the generally U-shaped member may include one or more gripping features configured to help the generally U-shaped member grip the surface of the wall or structure. For example, the surface of the front portion 472 facing away from the support system 406 may include one or more rubber ridges configured to help the anchoring system 408 grip a wall or structure.

In an embodiment, the generally U-shaped member and/or the anchor portion 476 may include an inner structure housed within an outer padded structure, fabric envelope, or sleeve member. Such a configuration may help protect surfaces the top portion 470, front and back portions 472, 474, and/or the anchor portion 476 of the anchoring system 408 engage. In other embodiments, the anchoring system 408 may be made of the same or similar materials as described with reference to the support system 406 and/or the container 402. In other embodiments, the anchoring system 408 may be formed of different materials than the support system 406 and/or the container 402.

The anchor portion 446 may be connected to a lower portion of the back portion 474 and may exhibit any configuration suitable to help anchor the anchoring system 408 on a structure or wall. For example, as shown, the anchor portion 476 may include a hollow generally cylindrical sleeve 478 and a core member 480 sized and configured to be positioned within the sleeve 478. In an embodiment, the core member 480 may be formed of one or more resiliently compressible materials. For example, the core member 480 may be configured such that after the core member 480 is compressed and positioned between two walls, the core member 480 may resiliently expand to move toward its original shape such that the core member 480 can become anchored, wedged, or jammed between the two walls. Such materials may include polyethylene foam, rubber, fabric, or any other suitable material. In other embodiments, the core member 480 may comprise a fillable body such as an air filled rubber bladder. In yet other embodiments, the core member 480 may comprise a rubber member or any other suitable resiliently compressible body. In yet other embodiments, the anchor portion 476 may be formed of one or more resiliently flexible materials such as plastics, metals, or the like. For example, the anchor portion 476 may comprise a waffle-like structure or a sinusoidal wave-like structure that may be configured to resiliently flex in between two walls or structures to anchor the system 400 in a generally fixed position.

In an embodiment, the generally cylindrical core member 480 may include a central channel extending therethrough. The central channel may be configured to receive a support member configured to provide additional structural support to the core member 480. In other embodiments, the central channel may be configured to help distribute shear forces or other forces produced within the core member 450 as the core member compresses and/or expands.

In an embodiment, the core member 480 may be removable from the sleeve 478 such that the core member 480 may be washed, dried, and/or customized. For example, in an embodiment, the core member 480 may be interchangeable with other core members based on desired stiffness, size, weight, compressibility, or the like. In an embodiment, the sleeve 478 may include any of the same or similar materials as the support system 406. In other embodiments, the sleeve 478 may include materials specifically configured for the anchor portion 476. For example, the sleeve 478 may include a soft, nonabrasive cloth configured for paint preservation. In other embodiment, the sleeve 478 may include gripping features configured to help the anchor portion 476 grip one or more surfaces.

While the sleeve 478 and/or core member 480 are shown having a generally cylindrical configuration, in other embodiments, the sleeve 478 and/or core member 480 may exhibit a generally triangular configuration, a generally rectangular configuration, a generally cruciate configuration, a generally trapezoidal configuration, an irregular geometric configuration, combinations thereof, or any other suitable shape.

Figure 4G:
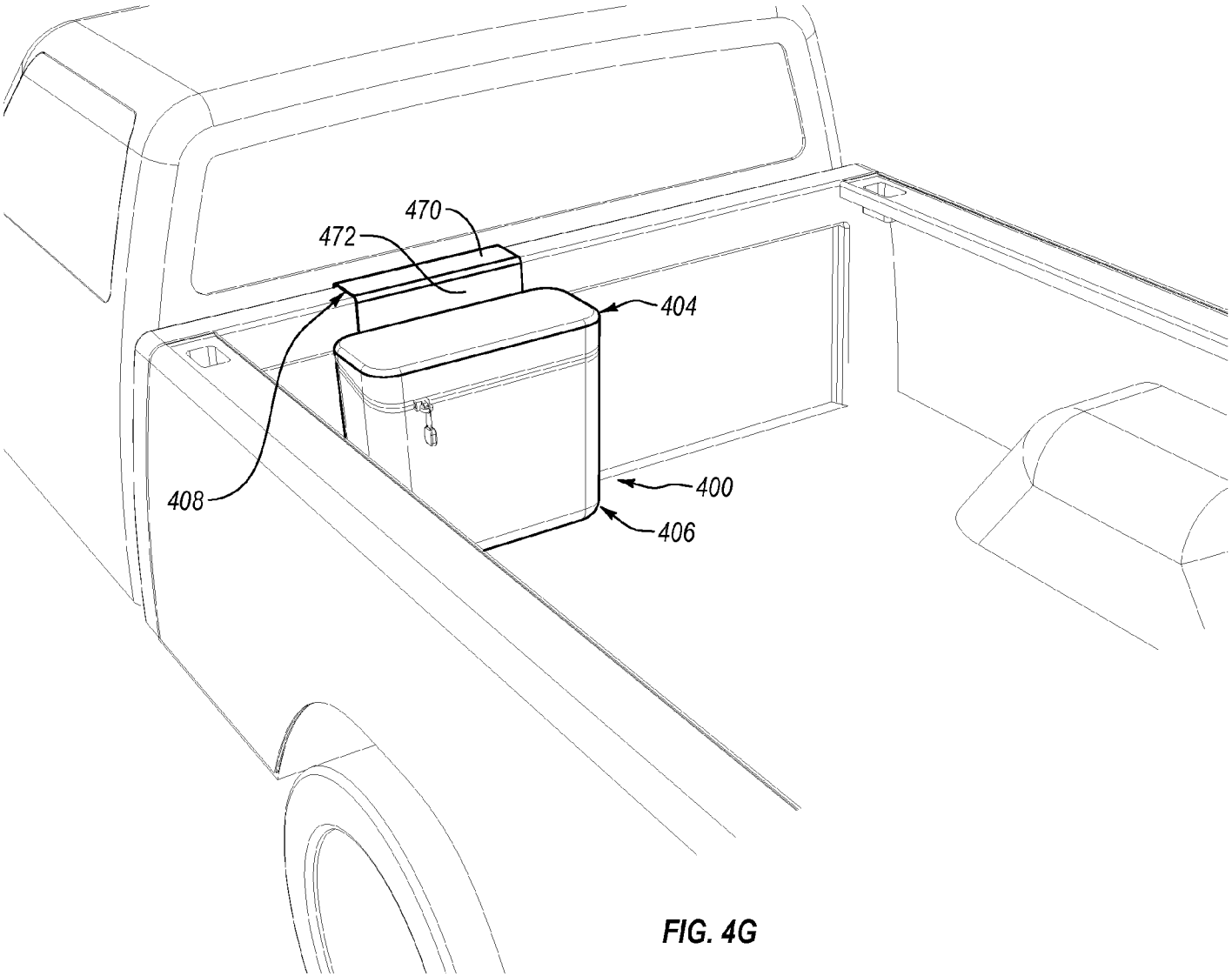
FIG. 4G is a isometric view of the system shown in FIG. 4A anchored in the bed of a pickup truck with the cab of the pickup truck removed.
Figure 4H:
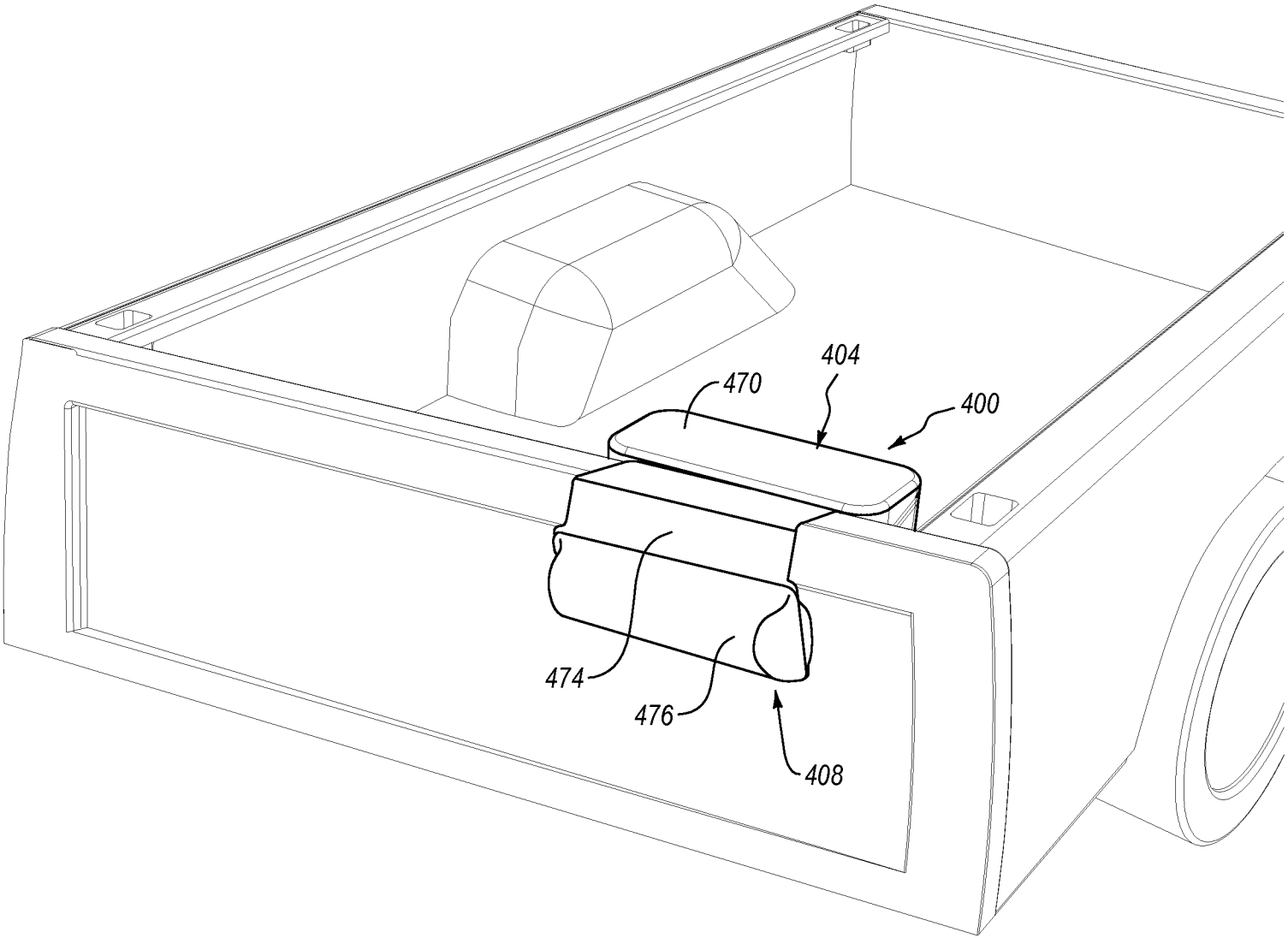
FIG. 4H is another isometric view of the system shown in FIG. 4A with the cab of the pickup truck removed.

The anchoring system 408 may be configured to anchor the system 400 to a wall or structure and/or between two walls or structures. For example, as shown in FIGS. 4G and 4H, the anchoring system 408 may be configured to be placed over the top of a front wall of a truck bed. As shown, the top portion 470 may lie against a top of the front wall when the anchoring system 408 is placed over the front wall. Further, front and back portions 472, 474 may generally lie against the front and back portions of the front wall, when the anchoring system 408 is placed over the front wall. The anchor portion 476 may be sized and configured to be positioned between the front portion of the front wall and a back wall of the cab of the truck. More specifically, the anchor portion 476 may be resiliently compressed between the front portion of the front wall of the truck bed and a back wall of the cab of the truck such that the anchor portion 476 resiliently engages the front and back walls. Accordingly, the anchor portion 476 may become selectively jammed or wedged between the front portion of the front wall of the truck bed and a back wall of the cab. By wedging the anchor portion 476 between the front wall of the truck bed and a back wall of the cab, vertical and/or lateral movement of the anchoring system 478 relative to the front wall may be restricted. Such a configuration may help prevent wind and/or movement of the truck from moving the system 400 from a selected position.

In other embodiments, the anchor portion 476 may include one or more gripping features configured to help the anchor portion 476 wedge itself between the front wall of the truck bed and a back wall of the cab. In addition, in the illustrated embodiment, the front portion of the front wall may include a recessed portion and an upper lip. The anchor portion 476 of the anchoring system 408 may be configured to be selectively positioned below the upper lip of the front wall such that upward movement of the anchor portion 446 relative to the front wall causes anchor portion 446 to engage the upper lip thereby prevent further upward movement of the anchor portion 476. Accordingly, in addition to becoming wedged between the front wall of the truck bed and a back wall of the cab, the anchor portion 476 may be further configured to provide a detent-type anchoring mechanism on the front wall of the truck bed.

To remove the anchoring system 408 from the front wall of the truck bed, a user may selectively compress the anchor portion 476 positioned between the front wall of the truck bed and the back wall of the cab such that it disengages therefrom. The user may then lift the anchor portion 476 upward to remove the anchoring system 408 from the front wall of the truck bed. In another embodiment, to remove the anchoring system 408, the user may exert an upward force on the anchor portion 476 that is sufficient to overcome the engagement between the anchor portion 476 and the front wall of the truck bed and/or the back wall of the cab. Such a configuration of anchoring system 408 may anchor or secure the system 400 on the front wall of the truck bed without drilling holes or making any permanent modifications to the pickup truck. Moreover, the compressible configuration of the anchor portion 476 may help protect paint, clear coats, and/or other finishes.

Figure 5:
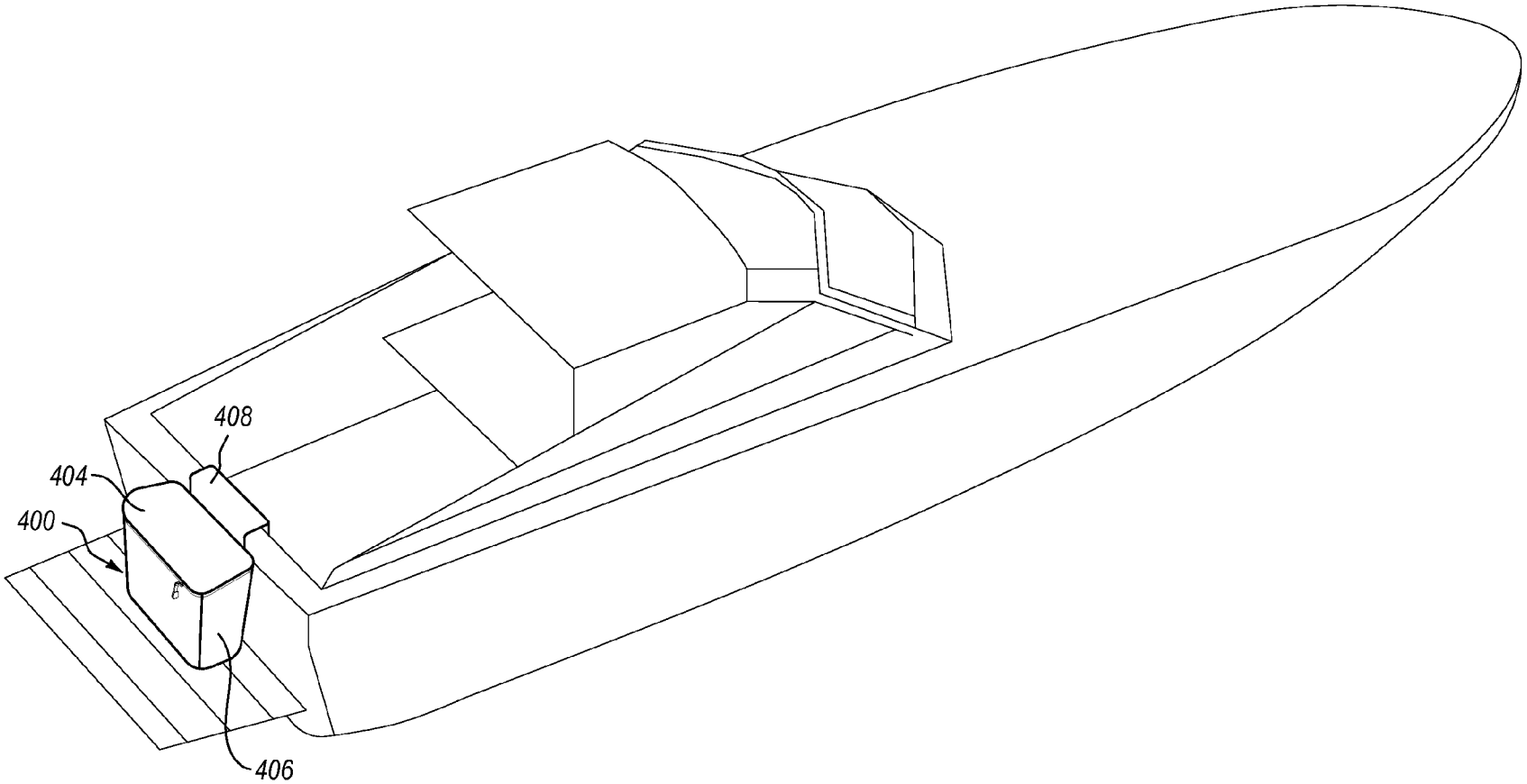
FIG. 5 is an isometric view of the system shown in FIG. 1A anchored on the back wall of a boat deck.

As shown in FIG. 5, the anchoring system 408 may be configured to be hook over the top of a back wall of a boat deck. As shown, the top portion 470 (shown in FIG. 4E) may lie against a top of the back wall when the anchoring system 438 is placed over the back wall. Further, front and back portions 472, 474 (shown in FIG. 4E) may lie against the front and back portions of the back wall, when the anchoring system 408 is placed over the back wall. In an embodiment, the back portion 474 may be resiliently biased inward such that the generally U-shaped member may clamp the system 400 onto a back wall of boat deck.

While the anchoring system 408 is shown and described in relation to the system 400 (i.e., support system 406 and the container 402), in other embodiments, any of the anchoring systems described herein may be configured for other uses. For example, in an embodiment, the anchoring system 408 may be configured to anchor a bike or motorcycle rack within a truck bed. In another embodiment, the anchoring system 408 may be configured to anchor a tool box, fishing pole racks, containers, coolers, tools, or any other suitable item within a truck bed or other area.

Figure 6:
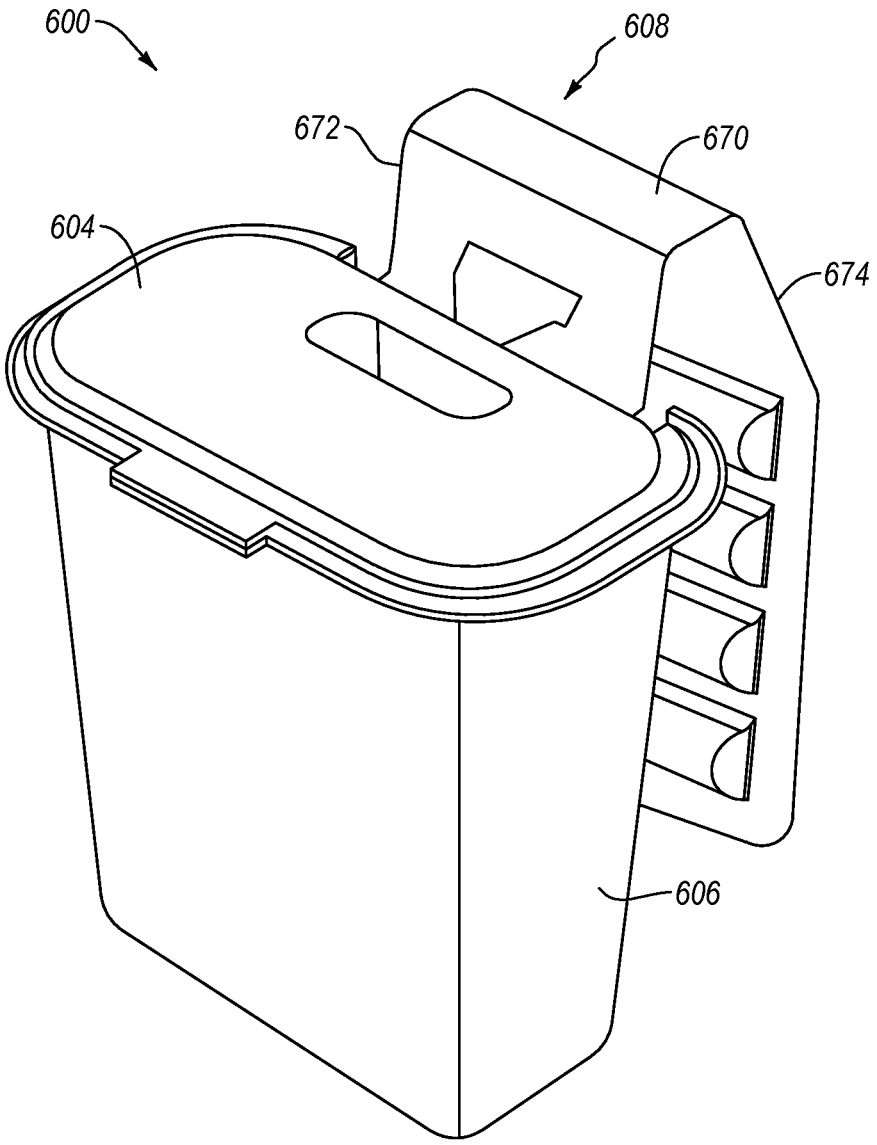
FIG. 6 is an isometric view of wind-resistant container system according to another embodiment.

FIG. 6 illustrates a wind-resistant container system 600 according to another embodiment. The system 600 includes many of the same components as the systems 100, 200, 300 and 400 shown in FIGS. 1A through 5. Therefore, in the interest of brevity, components of the system 600 that are identical or similar to each other have been provided with the same reference numerals, and an explanation of their structure and function will not be repeated unless the components function differently in the systems 100, 200, 300, 400, and 600. However, it should be noted that the principles of the system 600 can be employed with any of the embodiments described with respect to FIGS. 1A through 5.

The wind-resistant system 600 may include a support system 606, a container 602 (not shown), a lid 604, and an anchoring system 608. As shown, the support system 606 may comprise an exterior casing and the container 602 may comprise a liner 602, each having an open top generally rectangular configuration. The container 602 may be configured to be selectively positioned within the support system 606. Like the support system and container 406, 402, the support system and container 606, 602 may exhibit any suitable configuration and may be formed of any suitable material. For example, the support system 606 and/or the container 602 may be formed of molded, pressed, and/or extruded thermoplastic.

The lid 604 may be configured to selectively cover the top opening of the support system 606 and/or the container 602. In an embodiment, the lid 604 may be attached to an upper edge of the back side wall of the support system 606 along a substantial length of the back side wall to form a hinge between the lid 604 and the support system 606. The hinge may allow the lid 604 to be pivoted between a closed position and an open position. As shown, the support system 606 may include a flanged portion that forms a seat for the lid 604 such that the lid 604 is at least partially recessed within the support system 606. Moreover, the lid 604 may include a handle portion configured to a user maneuver the lid 604 between the open and closed positions. The lid 604 may be formed of any of the materials discussed with reference to lid 104, 204, 304, or 404. Optionally, the system 600 may include one or more closure elements configured to selectively secure the lid 604 in the closed position. In other embodiments, the closure elements may be omitted.

The anchoring system 608 may be connected to an upper portion of the back side wall of the support system 606. In an embodiment, the anchoring system 608 may be configured to help anchor the system 600 to one or more surfaces, walls, and/or structures. Like the anchoring system 108, the anchoring system 608 may exhibit any suitable configuration. For example, the anchoring system 608 may comprise an generally U-shaped member or an inverted trapezoid-like portion including a top portion 670, and a front portion 672 and a back portion 674, each extending generally downward from opposite ends of the top portion 670. The front portion 672 may be connected to an upper portion of the back side wall of the support system 602 and the back portion 674 may be generally parallel and/or non-parallel to the front portion 672.

The anchoring system 608 may include one or more features configured to help the anchoring system 608 anchor or secure the system 600 to a wall or structure. For example, the front and/or back surface of the back portion 674 may include one or more convex portions or semi-cylindrical portions configured to engage a wall or structure. In an embodiment, these convex portions may include gripping elements configured to grip the back of the side wall. In addition, the back portion 674 may be resiliently biased toward the front portion 672 such that the generally U-shaped member may clamp the anchoring system 608 onto a wall or structure. Such a configuration may help restrict vertical and/or lateral movement of the anchoring system 600 relative to the wall or structure.

In other embodiments, the anchoring system 608 may be configured to be jammed or wedged between two walls. For example, the convex portions of the back portion 674 may include one or more resiliently flexible materials such that when the back portion 674 is positioned between two walls or structures, the convex portions flex toward become more flattened out and then attempt to return to their original shape such that the convex portions can become anchored, wedged, and/or jammed between the walls. In an embodiment, the one or more resiliently flexible materials may include plastics, rubber, metals, metal alloys, composites, combinations thereof, or the like. Such a configuration can help limit vertical and/or lateral movement of the anchoring system 608 relative to the walls due to wind, water, and/or movement from moving the system 600. Moreover, the anchoring system 608 may anchor or secure the system 600 on one or more walls without drilling holes or making permanent modifications to the walls. In addition, because there are a number of convex portions, the anchoring system 608 may provide multiple anchoring levels.

Figure 7:
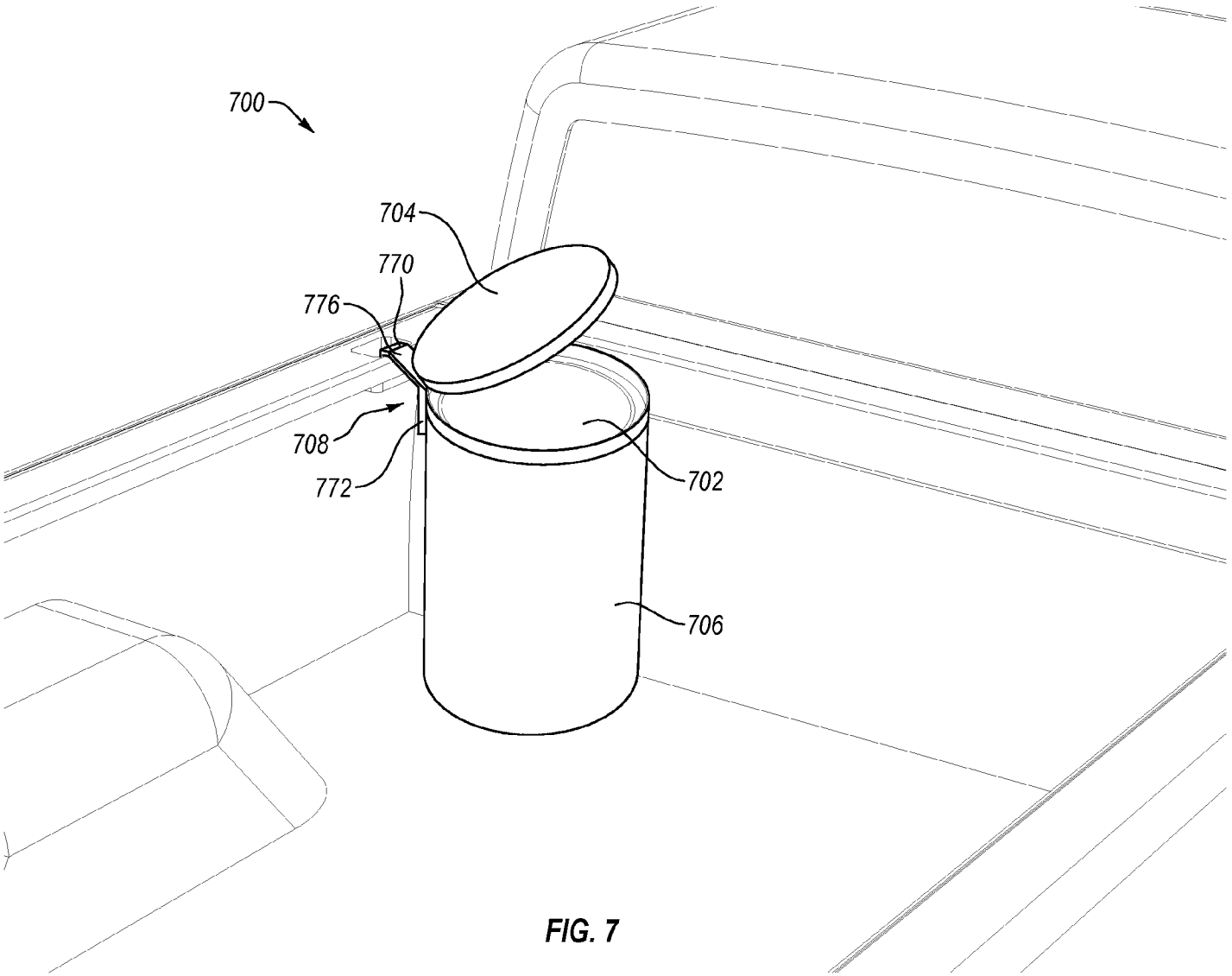
FIG. 7 is an isometric view of a wind-resistant container system anchored in the bed of a pickup truck according to another embodiment.

FIG. 7 illustrates a wind-resistant container system 700 according to another embodiment. The system 700 includes many of the same components as the systems 100, 200, 300, 400, and 600 shown in FIGS. 1A through 6. Therefore, in the interest of brevity, components of the system 700 that are identical or similar to each other have been provided with the same reference numerals, and an explanation of their structure and function will not be repeated unless the components function differently in the systems 100, 200, 300, 400, 600, 700. However, it should be noted that the principles of the system 700 can be employed with any of the embodiments described with respect to FIGS. 1A through 6.

The wind-resistant system 700 may include a support system 706, a container 702, a lid 704, and an anchoring system 708. In an embodiment, the support system 706 may comprise an exterior casing and the container 702 may comprise a liner, each exhibiting an open top generally cylindrical configuration.

The container 702 may be configured to be selectively positioned within the support system 706. As shown, the support system 706 may have an overall height that greater than an overall height of the container 702 such that the container 702 is recessed within the support system 706 when the container 702 is positioned within the support system 706. Accordingly, the support system 706 may form a physical barrier over the container 702. Such a configuration may help prevent wind, water, or the like from accessing the receiving space of the container 702. Like the support system 406 and the container 402, the support system 706 and/or the container 702 may exhibit any suitable configuration and may be formed of any suitable material. For example, the support system 706 may include one or more metals and the container 702 may be formed of one or more rigid plastic materials. In other embodiment, the support system 706 and/or the container 702 may include one or more textile materials.

The lid 704 may be configured to selectively cover the top opening of the support system 706 and/or the container 702. In an embodiment, the lid 704 may be attached to an upper edge of the back side wall of the support system 706 along a substantial length of the back side wall to form a hinge between the lid 704 and the support system 706. The hinge may allow the lid 704 to be pivoted between a closed position and an open position. Optionally, the system 700 may include one or more closure elements configured to selectively secure the lid 704 in the closed position. In other embodiments, the closure elements may be omitted.

In the illustrated embodiment, the anchoring system 708 may be connected to an upper portion of the back side wall of the support system 706. The anchoring system 708 may exhibit any suitable configuration. As shown in FIG. 7, the anchoring system 708 may comprise a hook-like member sized and configured to be selectively secured within an opening located along the top of the side wall of a truck bed. For example, the hook-like member may include a top portion 770, a back portion 774 (not shown) extending downward from an end of the top portion 770, an angled portion 776 extending downward and away from an opposite end of the top portion 770, and a front portion 772 extending downward from the angled portion 776. As shown, the top portion 770 may lie against a top of the side wall when the anchoring system is placed on the side wall. Further, the back portion 774 may generally lie within the opening in the top of the sidewall, when the anchoring system is placed over the side wall. In an embodiment, the hook-like member may include one or more ferromagnetic materials such that magnetism may help anchor the system 700 to the side wall. In another embodiment, the back portion 774 may include a lower tab member configured to hook or extend under the top of the side wall within the opening. Such a configuration may provide an easy and convenient way of anchoring the system 700 within a truck bed without making any permanent modifications to the truck bed. Thus, the system 700 may help maintain the integrity of a user's vehicle or watercraft. Moreover, in combination with the opening in the top of the side wall, the anchoring system 708 may be configured to limit vertical and/or lateral movement of the system 700 due to wind, water, movement of the truck, or the like. As a result, the system 700 can be securely and quickly anchored to the truck.

Figure 8A:
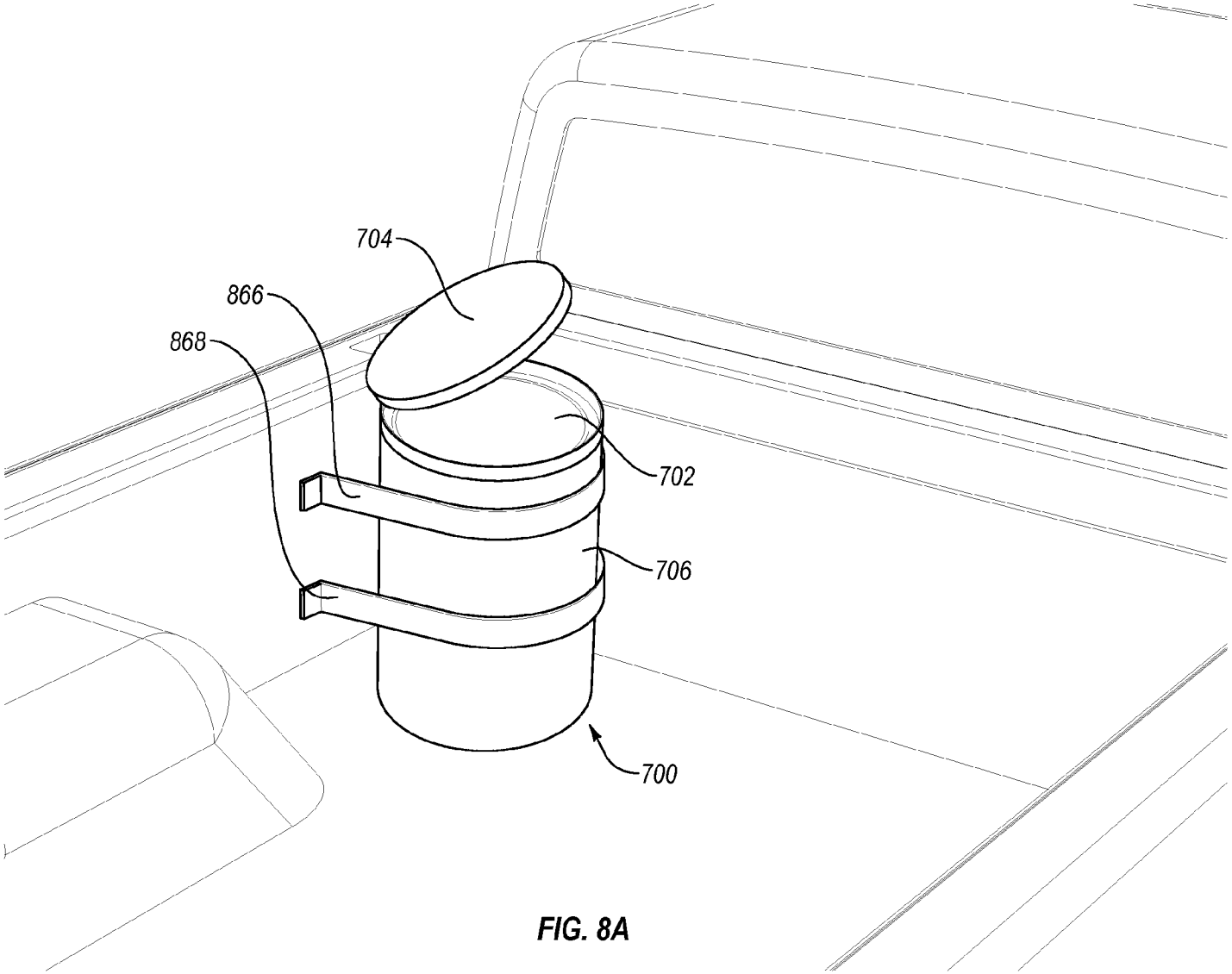
FIG. 8A is an isometric view of a wind-resistant container system anchored in the bed of a pickup truck according to another embodiment.
Figure 8B:
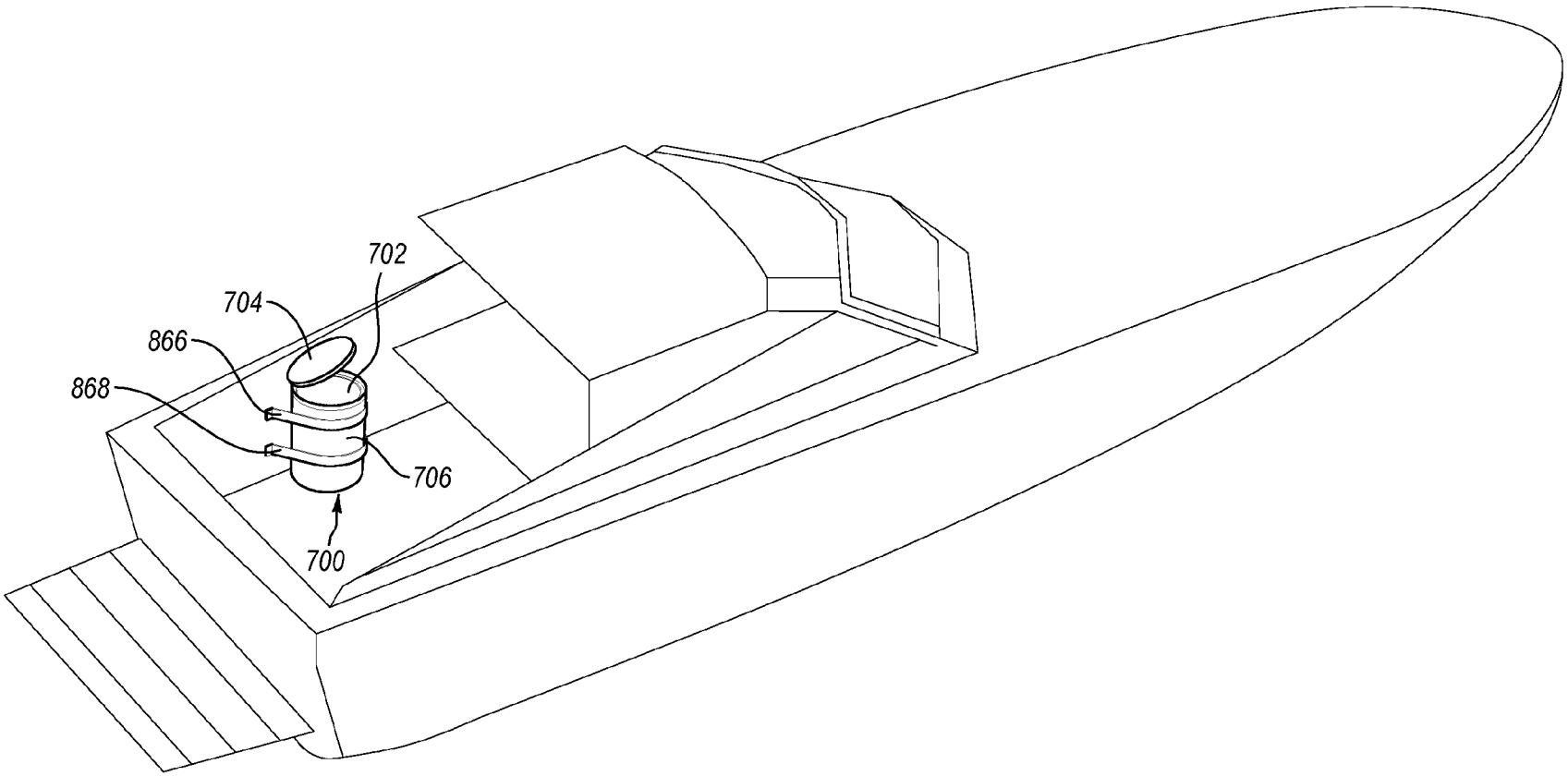
FIG. 8B is an isometric view of the wind-resistant container system shown in FIG. 8A anchored on the side wall of a boat deck according to another embodiment.

As noted above, the anchoring system may exhibit any suitable configuration. For example, in an embodiment, the anchoring system 808 may comprise first and second strap members 866, 868 configured to anchor the system 700 to the side wall of the truck bed as shown in FIG. 8A. Each of the first and second strap members 866, 868 may include opposite end portions and an intermediate portion extending between the end portions. The end portions of the first strap member 866 may be connected to the side wall of the truck bed and a portion of the intermediate portion may be attached to an upper exterior surface of the support system 706. Similarly, the end portions of the second strap member 868 may be connected to the side wall of the truck bed below the first strap and a portion of the intermediate portion may be attached to a lower exterior surface of the support system 706. The end portions of the first and second strap members 866, 868 may be connected to the side wall via any suitable means such as magnets, buttons, snaps, Velcro® (a hook and loop type closure system), clasps, latch systems, combinations thereof, or any other suitable attachment means. In other embodiments, the anchoring system 808 may be configured to anchor the system 700 on the side wall of a boat deck as shown in FIG. 8B.

While the anchoring system 808 is illustrated into two strap members, in other embodiments, the anchoring system 808 may include one strap member, three strap member, four strap members, or any other suitable number of strap members. For example, the anchoring system 808 may comprise a strap member attached to the support system 706 and configured to wrap around a wall structure, such as, but not limited to, a tailgate. In an embodiment, the strap member 808 may loop over the upper surface of the tailgate, around the exterior surface of the tailgate, under the tailgate between the truck bed and the tailgate, and back to the support system 706.

Figure 9:
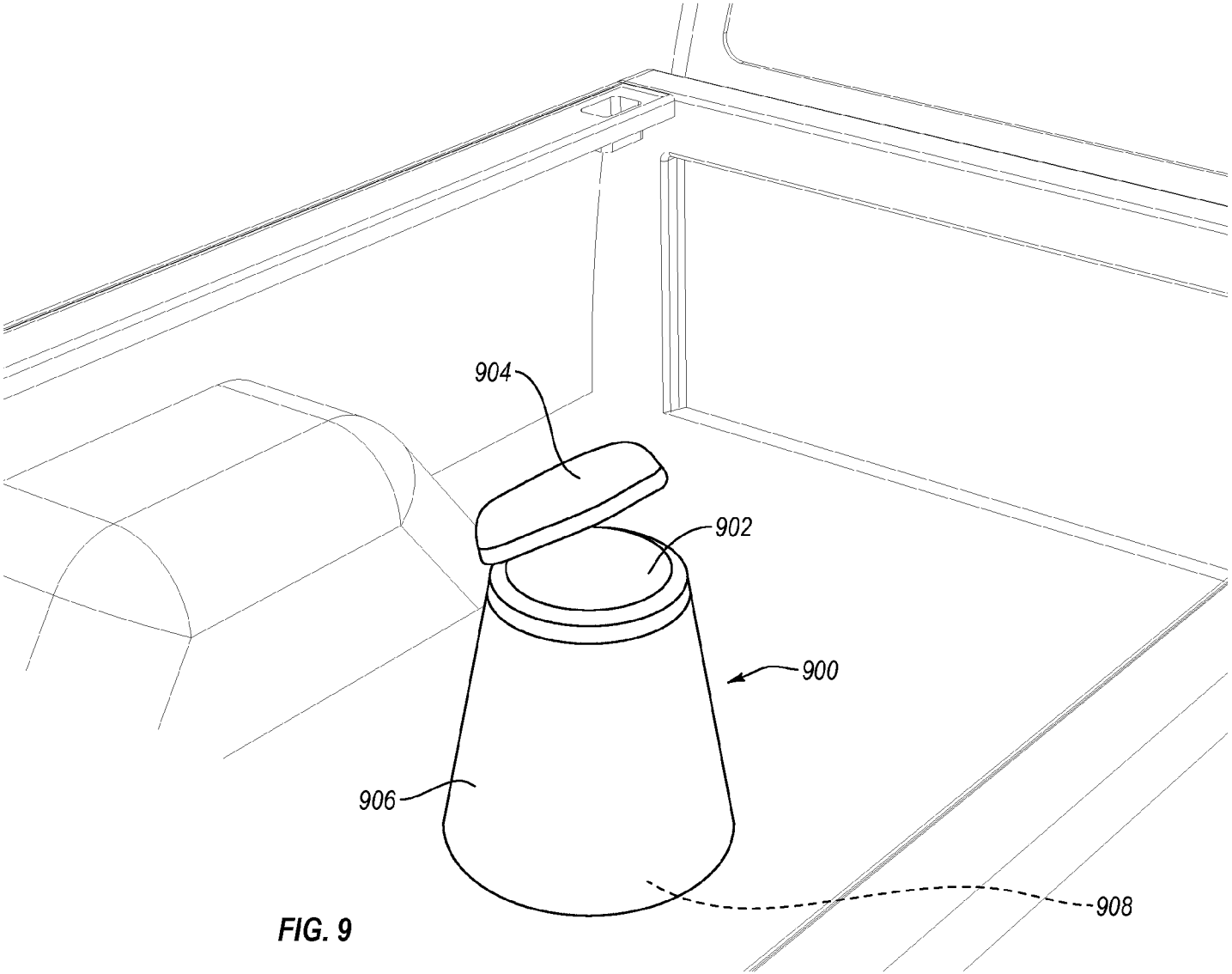
FIG. 9 is an isometric view of a wind-resistant container system according to another embodiment.

FIG. 9 illustrates a wind-resistant container system 900 according to another embodiment. The system 900 includes many of the same components as the systems 100, 200, 300, 400, 600, and 700 shown in FIGS. 1A through 8B. Therefore, in the interest of brevity, components of the system 900 that are identical or similar to each other have been provided with the same reference numerals, and an explanation of their structure and function will not be repeated unless the components function differently in the systems 100, 200, 300, 400, 600, 700, and 900. However, it should be noted that the principles of the system 900 can be employed with any of the embodiments described with respect to FIGS. 1A through 8B.

The system 900 may include a support system 906, a container 902, a lid 904, and an anchoring system 908. In an embodiment, the support system 906 may comprise an exterior casing and the container 902 may comprise a liner. Each may exhibit an open top, flat bottom generally conical configuration.

The container 902 may be configured to be selectively positioned within the support system 906. Like the support system and container 406, 402, the support system and container 906, 902 may exhibit any suitable configuration and may be formed of any suitable material. The lid 904 may be pivotally or removably connected to the support system 906 such that the lid 904 may move between an open position and a closed position. Optionally, the system 900 may include one or more closure elements configured to selectively secure the lid 904 in the closed position. Thus, the system 900 may help protect contents within the container 906 from wind, water, children, or the like.

In the illustrated embodiment, the anchoring system 908 may be associated with a lower portion of the support system 906. The anchoring system 908 may exhibit any suitable configuration. For example, as shown in FIG. 9, the anchoring system 908 may comprise a weighted base of the support system 906. In an embodiment, the weighted base may comprise a space in the lower portion of the support system 906 configured to be filed with filler such as water, sand, or other pourable material. In another embodiment, the weighted base may comprise a base portion of the support system 906 having a greater thickness and being formed at least in part by concrete, steel, rocks, iron, or other suitable heavy material. Such a configuration of the anchoring system 908 may help anchor the system 900 on the bottom portion of the truck bed or a boat deck without making permanent modifications.

While various aspects and embodiments have been disclosed herein, other aspects and embodiments are contemplated. The various aspects and embodiments disclosed herein are for purposes of illustration and are not intended to be limiting. Additionally, the words "including," "having" and variants thereof (e.g., "includes" and "has") as used herein, including the claims, shall be open ended and have the same meaning as the word "comprising" and variants thereof (e.g., "comprise" and "comprises").

What is claimed is:

1. A wind-resistant container system comprising:

a container including a bottom, one or more side walls, a receiving space at least partially defined by said bottom and said one or more side walls, and an opening providing access to said receiving space;

a lid connected to said container, said lid being movable between an open position, wherein said lid is moved away from said opening to provide access to said opening, and a closed position, wherein said lid substantially covers said opening;

one or more closure elements configured to selectively secure said lid in said closed position such that said receiving space is protected from wind;

an anchoring system operably connected to said container and configured to anchor said container on a wall structure without forming a permanent hole in the wall structure, said anchoring system including a front portion positionable on a first surface of the wall structure and a back portion positionable on a second surface of the wall structure; and a support system configured to retain or cradle said container therein, said support system including:

one or more bottom arms positioned and configured to extend across said bottom of said container;

one or more front arms connected to said one or more bottom arms and extending generally upward therefore, said one or more front arms configured to engage at least a portion of said one or more side walls of said container; and one or more back arms connected to said one or more bottom arms and extending generally upward therefrom; said one or more back arms configured to engage at least another portion of said one or more side walls of said container.

2. The wind-resistant container system of claim 1, wherein said one or more closure elements comprise one or more bent sections of said one or more front arms that are selectively positionable on or over said lid of said container.

3. The wind-resistant container system of claim 1, wherein said container includes one or more guides configured to receive or position said one or more bottom arms, said one or more back arms, or said one or more front arms of said support system on said container.

4. The wind-resistant container system of claim 3, wherein said one or more guides comprise one or more grooves including a shoulder portion formed in said one or side walls, said shoulder portion being configured to limit vertical movement of said support system relative to said container.

5. The wind-resistant container system of claim 1, wherein said front portion of said anchoring system comprises a fixed portion and wherein said back portion of said anchoring system comprises a movable portion that is movable relative to said fixed portion.

6. The wind-resistant container system of claim 5, wherein said fixed portion includes a first clamping surface and wherein said movable portion includes a second clamping surface that is substantially parallel to said first clamping surface.

7. The wind-resistant container system of claim 5, wherein said anchoring system includes one or more threaded members extending between said fixed portion and said movable portion, wherein rotation of said one or more threaded members in a first direction moves said movable portion toward said fixed portion, and wherein rotation of said one or more threaded members in a second direction moves said movable portion away from said fixed portion.

8. The wind-resistant container system of claim 7, wherein said one or more threaded members are configured to at least partially maintain said first clamping surface and said second clamping surface substantially parallel.

9. The wind-resistant container system of claim 5, wherein said fixed portion includes a substantially horizontal section configured to engage an upper surface of the wall structure and a substantially vertical section having a first clamping surface configured to engage the first surface of the wall structure.

10. The wind-resistant container system of claim 5, wherein said movable portion includes:

a plurality of support arms, each support arm including a substantially horizontal section configured to engage an upper surface of the wall structure and substantially vertical section; and a plate member extending between said vertical sections of said support arms, said plate member including a second clamping surface configured to engage the second surface of the wall structure, said second clamping surface being substantially parallel said first clamping surface.

11. The wind-resistant container system of claim 1, wherein said anchoring system includes:

a top portion including a first end region and a second end region, said top portion configured to substantially lie against an upper surface of the wall structure, wherein said front portion of said anchoring system extends substantially downward from said first end region of said top portion and said back portion of said anchoring system extends substantially downward from said second end region of said top portion; and a resiliently compressible anchor portion attached to said back portion, said anchor portion being positioned and configured to be selectively wedged, anchored, or jammed between the wall structure and another surface.

12. The wind-resistant container system of claim 11, where said anchor member comprises a high-density foam member.

13. The wind-resistant container system of claim 1, wherein at least a portion of said lid overlaps at a portion of said one or more walls of said container when said lid is in said closed portion.

14. The wind-resistant container system of claim 1, wherein said lid includes a lower surface including one or more recessed portions configured to receive one or more raised portions formed on an upper edge of said container when said lid is in the closed position.

15. A anchoring system for a pickup truck bed, the system comprising:

a fixed portion including a substantially horizontal section configured to engage an upper surface of a wall of the pickup truck bed and a substantially vertical section comprising a first clamping surface configured to engage a first side surface of the wall;

a movable portion including:

a pair of support arms, each support arm including a substantially horizontal section configured to engage the upper surface of the wall and substantially vertical section; and a plate member extending between said substantially vertical sections of said support arms, said plate member including a second clamping surface configured to engage a second side surface of the wall, said second clamping surface being substantially parallel said first clamping surface; and one or more threaded members extending between said fixed portion and said movable portion, wherein rotation of said one or more threaded members in a first direction moves said movable portion toward said fixed portion, and wherein rotation of said one or more threaded members in a second direction moves said movable portion away from said fixed portion.

16. The anchoring system of claim 15, wherein said one or more threaded members at least partially maintain said second clamping surface substantially parallel said first clamping surface.

* * * * *